United States Patent [19]

Jasmin et al.

[11] 4,293,923

[45] Oct. 6, 1981

[54] SYSTEM FOR SIMULATING THE OPERATING CHARACTERISTICS OF ELECTRIC MACHINES

[75] Inventors: Gilles Jasmin, Sherbrooke; John P. Bowles, St.-Bruno, both of Canada

[73] Assignee: Hydro-Quebec, Montreal, Canada

[21] Appl. No.: 30,787

[22] Filed: Apr. 17, 1979

[51] Int. Cl.[3] ..... G06G 7/63; G06G 7/34

[52] U.S. Cl. ..... 364/802; 364/815

[58] Field of Search ..... 364/802, 800–809

[56] References Cited

U.S. PATENT DOCUMENTS

| | | | |
|---|---|---|---|
| 2,999,638 | 9/1961 | Brownlee | 364/802 |
| 3,723,718 | 3/1973 | Jaffe et al. | 364/802 |
| 3,826,906 | 7/1974 | Carlson et al. | 364/802 X |

FOREIGN PATENT DOCUMENTS

| | | | |
|---|---|---|---|
| 264807 | 3/1970 | U.S.S.R. | 364/802 |
| 264808 | 3/1970 | U.S.S.R. | 364/802 |
| 560241 | 7/1977 | U.S.S.R. | 364/802 |

OTHER PUBLICATIONS

Corless et al., An Experimental Electronic Power System Simulator, The Institution of Electrical Engineers, Paper No. 2673s, Oct. 1958.

*Primary Examiner*—Felix D. Gruber

*Attorney, Agent, or Firm*—Schwartz, Jeffery, Schwaab, Mack, Blumenthal & Koch

[57] ABSTRACT

The invention concerns the analog simulation of the parameters and the operating characteristics of three-phase rotating machines. The system comprises a unit for transforming the three-phase armature currents of a machine into equivalent diphase currents and a further unit for transforming the diphase currents into currents so-called of direct and quadrature axes. A generator and control circuit simulates the parameters and operating characteristics of the machine in function of those currents of direct and quadrature axes, and feeds another circuit for generating diphase voltages. These diphase voltages are then transformed into three-phase voltages from which the dynamic characteristics of the machine are generated.

20 Claims, 14 Drawing Figures

57
58
57A
59
60
61
62
63
64
65
66
67
68
69
-1
-3
-2
$3\bar{v}_{mds}$
$3\bar{v}_{mqs}$
$-\bar{v}_{kd}$
$-\bar{v}_{kq}$
$-\bar{v}_f$
$\bar{i}_{kd}$
$\bar{i}_{kq}$
$\frac{1}{3\bar{R}_{kd}}$
$\frac{1}{3\bar{R}_{kq}}$
$\frac{1}{3\bar{R}_{fd}}$
$-\frac{120}{s}$
$-\frac{1.2}{s}$
$-\frac{\omega_{base}}{400}$
$10\bar{R}_{kd}$
$10\bar{R}_{kq}$
$1000\bar{R}_f$
$f_{base} = 25 \text{ or } 60 \text{ Hz}$
$2\bar{i}_{fd}$
$\frac{\bar{e}_f \cdot \bar{L}_{ad}}{\bar{R}_f}$
$\bar{L}_{ad}$
$\bar{E}_{fd} = \frac{\bar{e}_f \cdot \bar{L}_{ad}}{\bar{R}_f}$

SYSTEM FOR SIMULATING THE OPERATING CHARACTERISTICS OF ELECTRIC MACHINES

The present invention concerns the simulation of the operation characteristics and parameters of three-phase rotating machines, and relates more particularly to a machine working as an alternator, a synchronous compensator, an induction motor or a synchronous motor.

With the advent of modern technology, simulators at large have encountered a renewal in popularity since, in addition to their capacity of simulating actual machines by means of highly improved reduced size models, they operate in real time and without interruption. Among the known systems for simulating operation of rotating machines generating electric energy, there exists a type so-called micro-machine which is in fact a reproduction at a reduced scale of a generator used in hydroelectric generating plants. Those micro-machines however remain bulky, are difficult to operate, offer a low quality factor relative to the stator windings and present an incomplete simulation of the characteristics and parameters of real generators.

The object of the present invention resides in achieving a simulation system of the characteristics and parameters of a three-phase rotating machine and this in a completely electronic way.

According to the present invention, the simulation system of a three-phase rotating machine comprises first means for transforming three-phase armature currents into equivalent diphase currents and for transforming the latter diphase currents into currents following a direct axis and a quadrature axis, means for generating and controlling parameters and characteristics of the machine in function of the direct axis and quadrature axis currents, means for generating diphase voltages in response to said generating and controlling means, second means for transforming the diphase voltages into three-phase voltages, and means for generating dynamic characteristics of the machine in function of the three-phase voltages and the operation parameters and characteristics generated by the controlling and generating means.

Preferred embodiments of the present invention will be hereinafter described with reference to the accompanying drawings, wherein FIG. 1 shows a method of representing armature currents through a transformation of axes;

FIG. 2 schematically illustrates the various circuits constituting the simulation system according to the present invention;

MATHEMATICAL MODEL

Figure 1:
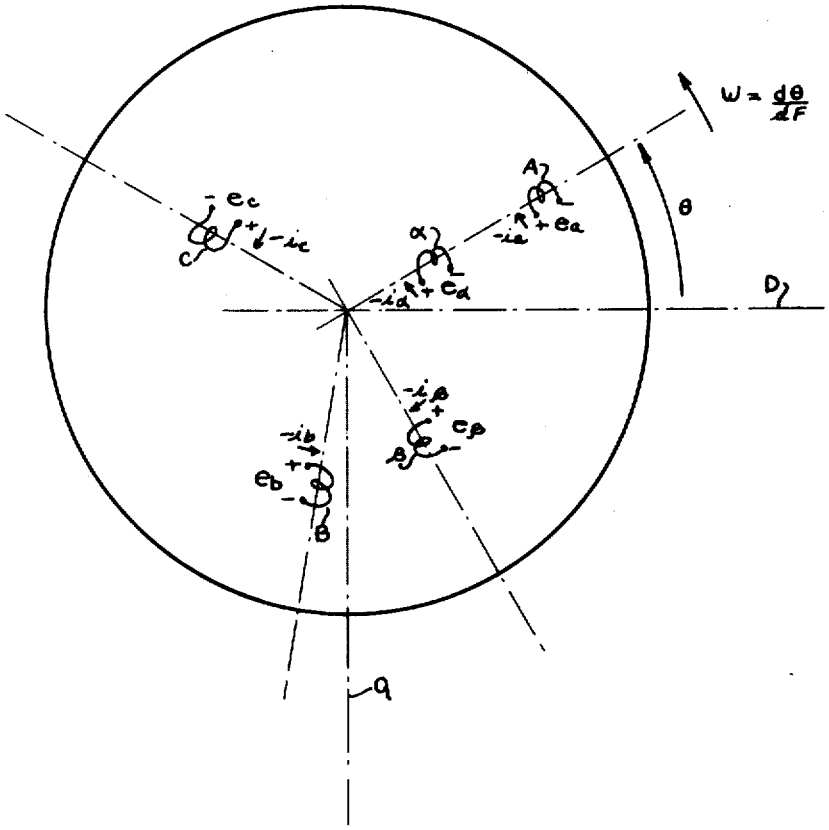

In order to comprehend well the physical model of the instant simulator, it is firstly desirable to size adequately the mathematical model onto which it is based. That mathematical model advocates axes transformations which render the inductances of the machine independent from the angular position of the rotor of the rotating machine, resulting in substantially simplifying the solution of the mathematical equations implied.

Among all the mathematical models suggested to represent a rotating machine, the most relevant one is undoubtedly that developed by Park an exhaustive analysis of which is given in the following works: Power System Stability: Synchronous Machines, by E.W. Kimbark (Dover—1968); The General Theory of Electrical Machines, By B. Adkins (Chapman and Hall—1964); Synchronous Machines, by C. Concordia (John Wiley & Sons—1951); and Electric Machinery, by Fitzgerald and Kingsley (McGraw Hill—1961). The mathematical model of Park effectively uses axes transformations to render the inductances of the machine independent from the angular position of the rotor, which considerably simplifies the achievement of a physical model of that machine.

It would be considered superfluous to give here all the steps that have led to the elaboration of the well-known equations of Park, but it is to be mentioned that the principle onto which they are based resides in the fact that only the relative angular speed between the stator and the rotor of a rotating machine is to be considered. That allows a representation of the armature windings as rotating at that speed and the remaining windings as fixed. According to that change, there are set an axis so-called a direct axis (designated as the D axis) and an axis so-called of quadrature with respect to the direct axis (designated as the Q axis), both remaining fixed in the space. In the differential equation of Park, all variables are expressed in relative values so that all the mutual inductances between the stator and the rotor remain equal with respect to one another according to the D axis as well as the Q axis. Also, if we assume that the leakage inductance of the stator windings is the same for the direct axis as for the quadrature axis, which is experimentally correct, the differential equation of a radial-pole machine when expressed in relative value and without considering saturation, as established by Park, are as follows $$\left.\begin{aligned}
\overline{e_d} &= \frac{P\overline{\psi_d}}{\omega_{base}} - \overline{\omega}\ \overline{\psi_q} - \overline{R}\ \overline{i_d} \\
\overline{e_q} &= \frac{P\overline{\psi_q}}{\omega_{base}} + \overline{\omega}\ \overline{\psi_d} - \overline{R}\ \overline{i_q} \\
\overline{e_o} &= \frac{P\overline{\psi_o}}{\omega_{base}} - \overline{R}\ \overline{i_o} \\
\overline{e_f} &= \frac{P\overline{\psi_f}}{\omega_{base}} + \overline{R_f}\ \overline{i_f} \\
O &= \frac{P\overline{\psi_{kd}}}{\omega_{base}} + \overline{R_{kd}}\ \overline{i_{kd}} \\
O &= \frac{P\overline{\psi_{kq}}}{\omega_{base}} + \overline{R_{kq}}\ \overline{i_{kq}}
\end{aligned}\right\} \quad (1)$$

In the above relations, $\overline{e}_d$ and $\overline{e}_q$ respectively designate the voltage at the terminals of the direct axis and the quadrature axis; $\overline{e}_f$ designates the voltage across the terminals of the field windings; and $\overline{e}_o$ designates the homopolar voltage. In addition, $\overline{\Psi}_d$ and $\overline{\Psi}_q$ respectively represent the total flux following the direct axis and the quadrature axis, whereas $\overline{\Psi}_o$ indicates the total homopolar flux and $\Psi_f$, $\overline{\Psi}_{kd}$ and $\overline{\Psi}_{kq}$ respectively represent the total flux of the field windings, the direct axis damper and the quadrature axis damper. Regarding the currents "i", they refer to the voltages having corresponding index, and R designates the corresponding resistance. P refers to a time operator. Moreover, the relative angular speed $\overline{\omega}$ is proportional to the real angular speed $\omega$ of the generator relative to the frequency $\omega_{base}$ which corresponds to that of the model.

Similarly, the total flux is expressed as follows:

$$\left.\begin{aligned}
\overline{\psi_d} &= -\overline{L_d}\ \overline{i_d} + \overline{L_{ad}}\ \overline{i_f} + \overline{L_{ad}}\ \overline{i_{kd}} \\
\overline{\psi_q} &= -\overline{L_q}\ \overline{i_q} + \overline{L_{aq}}\ \overline{i_{aq}} \\
\overline{\psi_o} &= -\overline{L_o}\ \overline{i_o} \\
\overline{\psi_f} &= -\overline{L_{ad}}\ \overline{i_d} + \overline{L_f}\ \overline{i_f} + \overline{L_{ad}}\ \overline{i_{kd}} \\
\overline{\psi_{kd}} &= -\overline{L_{ad}}\ \overline{i_d} + \overline{L_{ad}}\ \overline{i_f} + \overline{L_{kd}}\ \overline{i_{kd}} \\
\overline{\psi_{kq}} &= -\overline{L_{aq}}\ \overline{i_q} + \overline{L_{kq}}\ \overline{i_{kq}}
\end{aligned}\right\} \quad (2)$$

In the above equations, the inductances $\overline{L}_d$, $\overline{L}_q$, $\overline{L}_o$, $\overline{L}_f$, $\overline{L}_{kd}$ and $\overline{L}_{kq}$ respectively designate the characteristic inductance in the direct axis, in the quadrature axis, homopolar, of the field, of the direct axis damper and the quadrature axis damper. On the other hand, the symbols $\overline{L}_{ad}$ and $\overline{L}_{aq}$ correspond to the mutual inductances in the direct axis and the quadrature axis, respectively.

The above equations allow to achieve a simulator of the machine which is entirely electronic, but such a simulator would indeed be quite expensive by reasons of the large number of analogic multipliers necessary to realize it. Therefore, in order to simulate a rotating machine while employing a minimum of electronic units such as the analogic multipliers and hence to lower its manufacturing cost, the above equations are further modified by effecting a supplementary transformation of the axis, such a transformation resulting in an armature transformation converting a three-phase winding into an equivalent two-phase winding and vice-versa. Moreover, as it will be seen later, it is also economically advantageous to express the instantaneous power as well as the reactive power generated by means of two-phase components.

The supplementary axes transformation is schematically illustrated in FIG. 1. The two new windings designated by $\alpha$ and $\beta$ are set such that the first one be aligned with phase A and that the second one be in quadrature with the first winding. The mathematical expression of that transformation is therefore:

$$\begin{bmatrix} i_\alpha \\ i_\beta \\ i_o \end{bmatrix} = \frac{2}{3}\begin{bmatrix} 1 & -\frac{1}{2} & -\frac{1}{2} \\ 0 & \sqrt{3/2} & -\sqrt{3/2} \\ \frac{1}{2} & \frac{1}{2} & \frac{1}{2} \end{bmatrix}\begin{bmatrix} i_a \\ i_b \\ i_c \end{bmatrix} \quad (3)$$

where $i_a$, $i_b$ and $i_c$ respectively represent the current generated by phases A, B and C.

The mathematical form of the two-phase transformation in the direct axis and the quadrature axis becomes while using the representation of FIG. 1:

$$\begin{bmatrix} i_d \\ i_q \\ i_o \end{bmatrix} = \begin{bmatrix} \cos\theta & \sin\theta & 0 \\ -\sin\theta & \cos\theta & 0 \\ 0 & 0 & 1 \end{bmatrix}\begin{bmatrix} i_\alpha \\ i_\beta \\ i_o \end{bmatrix} \quad (4)$$

Those relations being established, let us now consider the expression for the resistive torque and the generated power.

To obtain a suitable expression for the resistive torque, the instantaneous power P delivered by the rotating machine, is to be considered first, which is given by:

$$P = e_a\, i_a + e_b\, i_b + e_c\, i_c = [e_a | e_b | e_c]\begin{bmatrix} i_a \\ i_b \\ i_c \end{bmatrix} \quad (5)$$

where $e_a$, $e_b$ and $e_c$ designate the voltages across the terminals of the windings of phases A, B and C, respectively.

According to the calculus effected by Park, the instantaneous power along axes D and Q is expressed:

$$P = 3/2[-r_a(i_d^2 + i_q^2) + i_d P\psi_d + i_q P\psi_q] + 3/2\omega(-i_d\psi_q + i_q\psi_d) + 3(-r_a i_o^2 - i_o L_o P_{io}) \quad (6)$$

From the latter relation 6, it is readily realized that only the terms containing $\omega$ represent a demand in active power from the electromagnetic gap coupling. Then, the resistive torque $\tau$, in relative value, will be given by:

$$\tau = \overline{i_q}\overline{\Psi_d} - \overline{i_d}\overline{\Psi_q} \quad (7)$$

The expression 5 of the instantaneous power delivered by the generator may be expressed by means of the two-phase components, in relative value:

$$\overline{P} = \overline{e_\alpha}\overline{i_\alpha} + \overline{e_\beta}\overline{i_\beta} + 2\overline{e_o}\overline{i_o} \quad (8)$$

On the other hand, it is also necessary to express the instantaneous reactive power generated by the machine. For that purpose, it is to be noted that when the voltages and the currents in the armature are sinusoïdal and in equilibrium, the generation of the instantaneous reactive power is defined, for a true generation, as follows:

$$e_a = E_m \cos(\omega t - \delta) \tag{9}$$

$$e_b = E_m \cos\left(\omega t - \delta - \frac{2\pi}{3}\right)$$

$$e_c = E_m \cos\left(\omega t - \delta + \frac{2\pi}{3}\right)$$

$$i_a = I_m \cos(\omega t - \delta - \alpha)$$

$$i_b = I_m \cos\left(\omega t - \delta - \alpha - \frac{2\pi}{3}\right)$$

$$i_c = I_m \cos\left(\omega t - \delta - \alpha + \frac{2\pi}{3}\right)$$

Where $E_m$ represents the armature phase peak voltage, $I_m$ the armature peak current and $\alpha$ the phase angle between the voltage and the current of one phase (power factor angle of the load). It is also noted that $\delta$ represents the load angle defined as the angle between the voltage of phase A and the quadrature fix axis.

Then, considering the following expressions:

$$e_b - e_c = \sqrt{3}\ E_m \cos(\omega t - \delta - \pi/2) \tag{10}$$

$$e_c - e_a = \sqrt{3}\ E_m \cos\left(\omega t - \delta - \frac{2\pi}{3} - \pi/2\right)$$

$$e_a - e_b = \sqrt{3}\ E_m \cos\left(\omega t - \delta + \frac{2\pi}{3} - \pi/2\right)$$

It is noted that $(e_b - e_c)$ is $\pi/2$ out of phase with respect to $e_a$, so is $(e_c - e_a)$ with respect to $e_b$ and also $(e_a - e_b)$ with respect to $e_c$. Then, the mathematical expression for $P_r$ may by expressed by:

$$P_r = \frac{1}{\sqrt{3}}\left[(e_b - e_c)i_a + (e_c - e_a)i_b + (e_a - e_b)i_c\right] \tag{11}$$

$P_r$ = instantaneous reactive power generated when the armature voltages and currents are sinusoidal and in equilibrium.

Therefore, when using the two-phase components defined above, the following relative value is obtained:

$$\overline{P}_r = \overline{e}_\beta \overline{i}_\alpha - \overline{e}_\alpha \overline{i}_\beta \tag{12}$$

Furthermore, to achieve a suitable simulation of the machine, saturation is to be considered in the above differential equations. First, it is assumed that the leakage flux of the inductor and armature windings are not affected by saturation. This leakage flux indeed flows mainly in the air-gap which is in conformity with the actual situation.

Let us consider the mutual flux of the direct axis and the quadrature axis which are represented by:

$$\overline{\Psi}_{md} = \overline{L}_{ad}(-\overline{i}_d + \overline{i}_f + \overline{i}_{kd}) = \overline{L}_{ad}\overline{i}_{md} \tag{13}$$

$$\overline{\Psi}_{mq} = \overline{L}_{aq}(-\overline{i}_q + \overline{i}_{kq}) = \overline{L}_{aq}\overline{i}_{mq}$$

where $\overline{i}_{md}$ = the magneto-motive force according to the direct axis $\overline{i}_{mq}$ = the magneto-motive force according to the quadrature axis $\overline{\Psi}_{md}$ = the mutual flux in the direct axis $\overline{\Psi}_{mq}$ = the mutual flux in the quadrature axis Then, the resulting magneto-motive force and the resulting mutual flux, which are utilized as a starting point in the determination of the saturation level, will be:

$$\overline{i}_m = \sqrt{\overline{i}_{md}^2 + \overline{i}_{mq}^2} = \text{resulting magneto-motive force} \tag{14}$$

$$\overline{\psi}_m = \sqrt{\overline{\psi}_{md}^2 + \overline{\psi}_{mq}^2} = \text{resulting air-gap mutual force}$$

Now, when the machine operates at a nominal speed and according to rated requirements, the equations 1 and 2 of Park become:

$$\overline{e}_d = -\overline{\psi}_q - \overline{R}\ \overline{i}_d \tag{15}$$

$$\overline{e}_q = \overline{\psi}_d - \overline{R}\ \overline{i}_q$$

$$\overline{e}_f = \overline{R}_f\ \overline{i}_f$$

$$\overline{\psi}_d = \overline{\psi}_{md} - \overline{L}_1\ \overline{i}_d$$

$$\overline{\psi}_q = \overline{\psi}_{mq} - \overline{L}_1\ \overline{i}_q$$

If the resistance R and the armature leakage inductance $L_1$ are neglected, then a voltage so-called the voltage preceding the armature leakage reactance is obtained. That voltage $e_s$ is expressed by:

$$\overline{e}_s = -\cos\theta\overline{\Psi}_{mq} - \sin\theta\overline{\Psi}_{md} \tag{16}$$

The resulting R.M.S. value will then be $$\overline{e}_{s(R.M.S.)} = \sqrt{\frac{1}{\pi}\int_0^{2\pi} \overline{e}_s^2\, d\omega t} = \overline{\psi}_m \tag{17}$$

Therefore, in a no-load condition, it may be said that:

$$\overline{\psi}_m \propto \frac{E_{al}}{E_{al,base}} = \overline{E}_{al} \tag{18}$$

wherein $E_{al}$ designates the R.M.S. line voltage generated.

Let us now consider the no-load saturation of the machine. As known, the generated voltage is directly proportional to the resultant mutual flux $\Psi_m$ during the no-load operation, and consequently to each resulting magneto-motive force $i_m$ corresponds a relative variation in the resulting air-gap mutual flux. This is given by the following relation $$\frac{\Delta\overline{\psi}_m}{\overline{\psi}_m} = \frac{k\overline{\psi}_m - k\overline{\psi}_{ms}}{k\overline{\psi}_m} = f(\overline{i}_m) \tag{19}$$

K = a proportionality coefficient $\overline{\Psi}_{ms}$ = the resulting saturated mutual flux $f(\overline{i}_m)$ = a saturation function.

In fact, that relation 19 represents the relative saturation rate in function of the resulting magnet-motive force. It is therefore possible to affect the mutual flux according to the direct and quadrature axes $\overline{\Psi}_{md}$ and $\overline{\Psi}_{mq}$ by that rate to obtain the saturated flux $\overline{\Psi}_{mds}$ and $\overline{\Psi}_{mqs}$, which are:

$$\overline{\psi}_{mds} = \overline{\psi}_{md}(1 - D f(\overline{i}_m)) \tag{20}$$

$$\overline{\psi}_{mqs} = \overline{\psi}_{mq}(1 - Q f(\overline{i}_m))$$

In equations 20, the parameters D and Q take into account the two following criteria:

(1) the no-load saturation curve is only valid for the direct axis, then D≠Q (except in the case of the machines provided with smooth-type poles where D=Q), (2) the quadrature axis is more difficult to saturate than the direct axis, therefore Q<1. This results from the fact that the air-gap along the quadrature axis is greater than that in the direct axis for the machines provided with radial poles.

In view of the above relations, the equations of Park then become $$\overline{e}_d = \frac{P\overline{\psi}_{ds}}{\omega_{base}} - \overline{\omega}\,\overline{\psi}_{qs} - \overline{R}\,\overline{i}_d \tag{21a}$$

$$\overline{e}_q = \frac{P\overline{\psi}_{qs}}{\omega_{base}} + \overline{\omega}\,\overline{\psi}_{ds} - \overline{R}\,\overline{i}_q \tag{21b}$$

$$\overline{e}_o = \frac{P\overline{\psi}_o}{\omega_{base}} - \overline{R}\,\overline{i}_o \tag{21c}$$

$$\overline{e}_f = \frac{P\overline{\psi}_{fs}}{\omega_{base}} + \overline{R}_f\,\overline{i}_f \tag{21d}$$

$$O = \frac{P\overline{\psi}_{kds}}{\omega_{base}} + \overline{R}_{kd}\,\overline{i}_{kd} \tag{21e}$$

$$O = \frac{P\overline{\psi}_{kqs}}{\omega_{base}} + \overline{R}_{kq}\,\overline{i}_{kq} \tag{21f}$$

$$\overline{\psi}_{ds} = \overline{\psi}_{mds} - \overline{L}_1\,\overline{i}_d \tag{21g}$$

$$\overline{\psi}_{qs} = \overline{\psi}_{mqs} - \overline{L}_1\,\overline{i}_q \tag{21h}$$

$$\overline{\psi}_o = -\overline{L}_o\,\overline{i}_o \tag{21i}$$

$$\overline{\psi}_{fs} = \overline{\psi}_{mds} + \overline{l}_{fd}\,\overline{i}_f \tag{21j}$$

$$\overline{\psi}_{kds} = \overline{\psi}_{mds} + \overline{l}_{kd}\,\overline{i}_{kd} \tag{21k}$$

$$\overline{\psi}_{kqs} = \overline{\psi}_{mqs} + \overline{l}_{kq}\,\overline{i}_{kq} \tag{21l}$$

$$\overline{i}_{md} = -\overline{i}_d + \overline{i}_f + \overline{i}_{kd} \tag{21m}$$

$$\overline{i}_{mq} = -\overline{i}_q + \overline{i}_{kq} \tag{21n}$$

$$\overline{i}_m = \sqrt{\overline{i}^2_{md} + \overline{i}^2_{mq}} \tag{21o}$$

-continued $$\overline{\psi}_{md} = \overline{L}_{ad}\,\overline{i}_{md} \tag{21p}$$

$$\overline{\psi}_{mq} = \overline{L}_{aq}\,\overline{i}_{mq} \tag{21q}$$

$$\overline{\psi}_{mds} = \overline{\psi}_{md}(1 - D f(\overline{i}_m)) \tag{21r}$$

$$\overline{\psi}_{mqs} = \overline{\psi}_{mq}(1 - Q f(\overline{i}_m)) \tag{21s}$$

$$f(\overline{i}_m) = \frac{\Delta\overline{\psi}_m}{\psi_m} \tag{21t}$$

where $\mathbf{1}_{fd}$, $\mathbf{1}_{kd}$ and $\mathbf{1}_{kq}$ are the field and damper leakage inductances in the direct and quadrature axes, respectively.

It is to be noted that the total homopolar flux never becomes saturated, since not crossing the air-gap.

Moreover, by taking into account the saturation effects, the resistive torque, the generated power and the reactive power become expressed by:

$$\overline{\tau} = \overline{i}_q\,\overline{\psi}_{ds} - \overline{i}_d\,\overline{\psi}_{qs} \tag{21u}$$

$$\overline{P} = \overline{e}_\alpha\,\overline{i}_\alpha + \overline{e}_\beta\,\overline{i}_\beta + 2\,\overline{e}_o\,\overline{i}_o \tag{21v}$$

$$\overline{P}_r = \overline{e}_\beta\,\overline{i}_\alpha - \overline{e}_\alpha\,\overline{i}_\beta \tag{21w}$$

ANALOGIC MODEL OF THE MACHINE

A general and a detailed description of the analogic model of a rotating machine will be hereinafter given while referring to the above-established mathematical relations.

Figure 2:
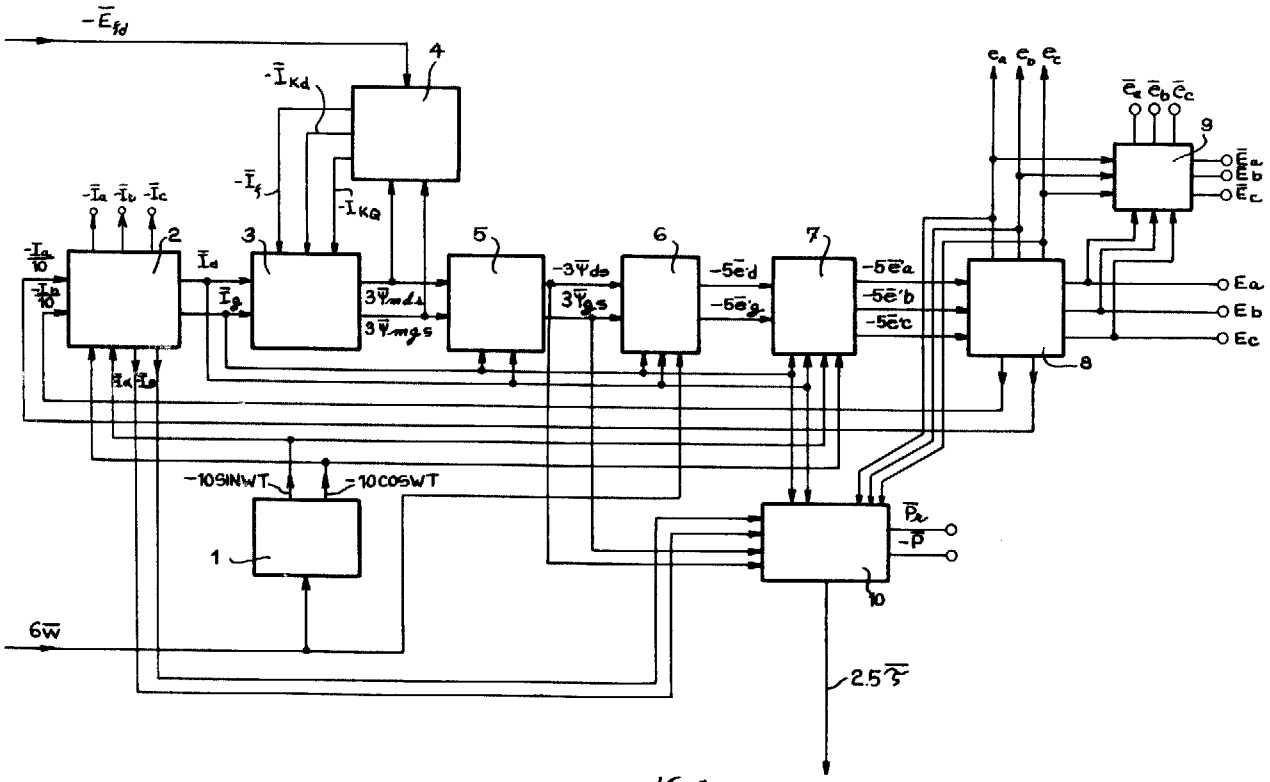

FIG. 2 illustrates the general analogic model of such a machine. Thus, there are shown therein all the various units capable of simulating in a realistic way the characteristics and parameters relative to the operation of a real three-phase rotating machine.

Thus, a sinusoidal oscillator 1 achieves the sin $\theta$ and cos $\theta$ functions of the above relation 4. That oscillator has a very low distortion level, offering two outputs which are exactly 90° out of phase with respect to one another. Besides presenting a great stability in frequency and in amplitude, the oscillator 1 generates a natural oscillation frequency directly proportional to a control voltage, thus permitting the incorporation of a turbine and a speed regulator into a simulated generator.

Those sin and cos functions feed an axis transformer 2 which also determines the value of the base power. That transformer 2 analogically realizes the above relation 3, in relative value, by transforming the three-phase currents into two-phase currents, while utilizing the fact that the sum of the three armature currents cancel one another, and ultimately transforms the two-phase currents into currents in the direct and quadrature axes. Thus, the armature currents $I_a$ and $I_b$ are transformed in relative currents $\overline{I}_d$ and $\overline{I}_q$.

Those relative currents $\overline{I}_d$ and $\overline{I}_q$ feed a generator unit 3 which analogically realizes the relations 21*m* to 21*t* by determining the mutual flux of saturation of the machine. The generator 3 is looped on another generator 4 which simulates the rotor currents $\overline{I}_f$, $\overline{I}_{kd}$ and $\overline{I}_{kq}$ of the machine. For that purpose, the mutual saturated flux are combined to a voltage $\overline{E}_{fd}$ equivalent to the field voltage produced by a generator.

The output of generator 3 supplies a generator 5 which combines the saturated mutual flux to currents $\overline{I}_d$ and $\overline{I}_q$ respectively for determining the total saturated flux $\overline{\Psi}_{ds}$ and $\overline{\Psi}_{qs}$ of the machine, this total saturated flux and the axes currents feeding a generator 6 which delivers a voltage, respectively according to the direct and quadrature axes, preceding the physical inductance of the armature of the simulator. The symbols $\overline{e}'_d$ and $\overline{e}'_q$ are utilized to represent those voltages. Generator 6 also simulates the negative armature inductance of the machine.

The voltages developed by generator 6 are transformed into three-phase voltages by generator 7 which additionally simulates the negative armature resistance. The generator 7 therefore produces through its output three voltages $\overline{e}'_a$, $\overline{e}'_b$ and $\overline{e}'_c$ which represent in fact the voltages preceding the armature physical inductance of a real rotating machine, in relative values.

The three-phase output of generator 7 is applied to a circuit 8 which allows the connecting of power amplifiers, of insulation transformers, of the armature physical inductance and of a network transformer. From circuit 8, there are obtained the three-phase high voltage values $E_a$, $E_b$ and $E_c$ as well as the three-phase low voltage values $e_a$, $e_b$ and $e_c$ of a generator. These various voltage values are fed into a measuring circuit 9 which provides the relative three-phase values.

The reactive power $\overline{P}_r$ as well as the instantaneous power P of the machine are determined by means of a generator 10 which additionally defines the resistive torque $\overline{\tau}$, the latter serving either to feed a turbine, in the case where the machine is a generator, or to represent the output torque of a motor. For that purpose, the generator 10 is supplied by the low voltage outputs of circuit 8, by the total saturated flux from generator 5 and by the currents $\overline{I}_\alpha$, $\overline{I}_\beta$, $\overline{I}_d$ and $\overline{I}_q$ generated by the axis transformer 2.

Each of the units mentioned above and which form the analog model of the rotating machine will be described in detail further and with reference to FIGS. 3 to 12 of the drawings.

SINUSOIDAL OSCILLATOR

Figure 3:
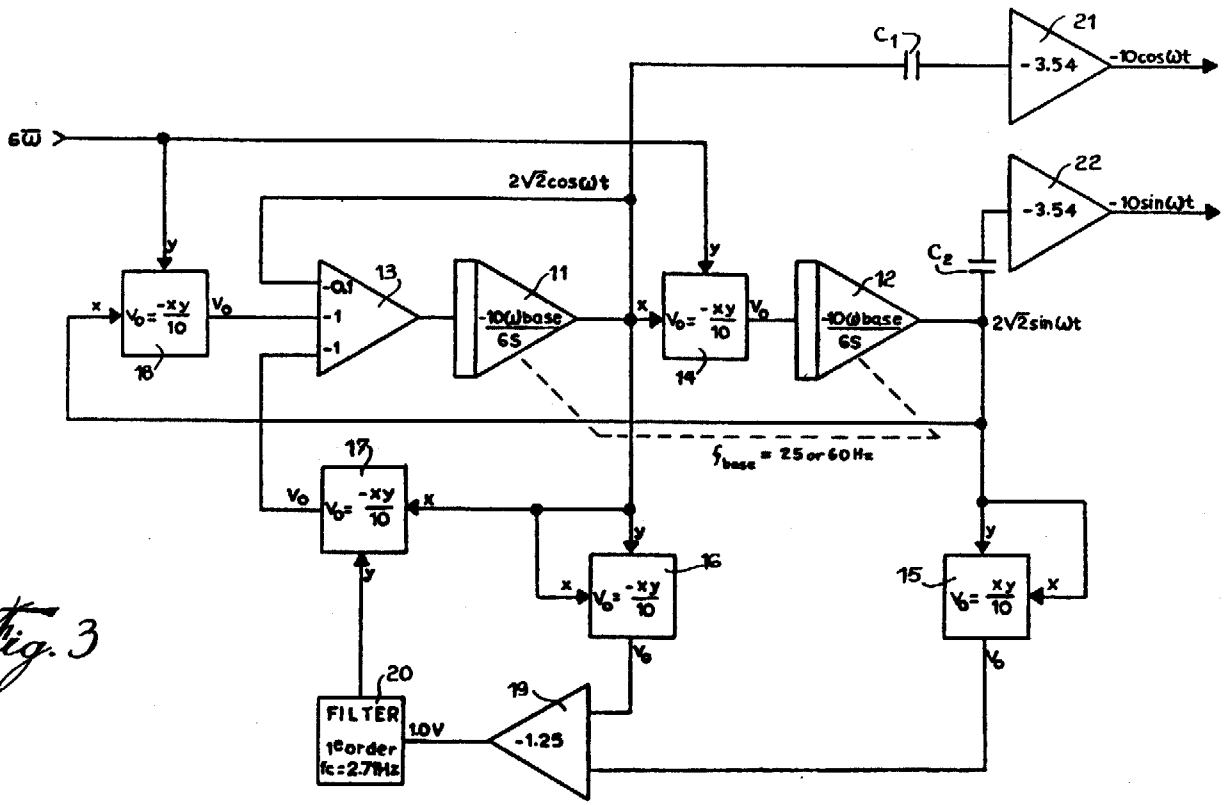
FIG. 3 depicts an oscillator circuit.

One important unit for the simulation of the machine is the sinusoidal oscillator designated by 1 in FIG. 2. Indeed, that oscillator has to realize the sin $\Theta$ and cos $\Theta$ functions of relation 4 elaborated above. FIG. 3 shows in detail a diagram of a sinusoidal oscillator which possesses a very low distortion and the two outputs of which are exactly 90° out of phase. That oscillator, besides having a high stability in frequency and in amplitude, generates a natural oscillation frequency which is directly proportional to a control voltage, thereby permitting the incorporation of a turbine and a speed regulator associated with a generator.

The operation principle of the oscillator illustrated in FIG. 3 is based onto the oscillation resulting from the interconnection of two integrators 11 and 12 and of a reversing device 13. The gain of the two integrators defines the natural oscillation frequency $\omega$ base. In order to set the amplitude "A" of the oscillation produced at a predetermined level, a multiplier 17 effects the multiplication of the output signal from integrator 11 to another signal rendered directly proportional to the amplitude of the oscillation by means of two multipliers 15 and 16 respectively connected to the output of the integrators 12 and 11. The outputs of those two multipliers 15 and 16 feed an adder-amplifier 19, the output signal of which is directly proportional to the amplitude of the oscillation.

In order to make the natural osciallation frequency of the oscillator directly proportional to a control voltage, the gain of the two integrators 11 and 12 is made directly proportional to that voltage by means of the analogic multipliers 14 and 18. In this case, for an oscillator having a frequency normalized at 25 or 60 Hz, a control of the frequency of the oscillator is achieved by multiplying each of the outputs of the two multipliers by a control voltage $\overline{\omega}$. Thus, the frequency of the oscillation issued from the integrator 11 is proportioned to the control voltage by the multiplier 18 whereas that from integrator 12 is so by the multiplier 14.

A low-pass filter 20 is inserted into the amplitude control loop so as to filter the hum signal produced by the two nonideal multipliers 15 and 16 squaring the signal of the loop.

The base frequency of integrators 11 and 12 may have a value of 25 Hz in addition to the normalized value of 60 Hz. It is noted that a base frequency of 50 Hz may as well be adopted.

Figure 4:
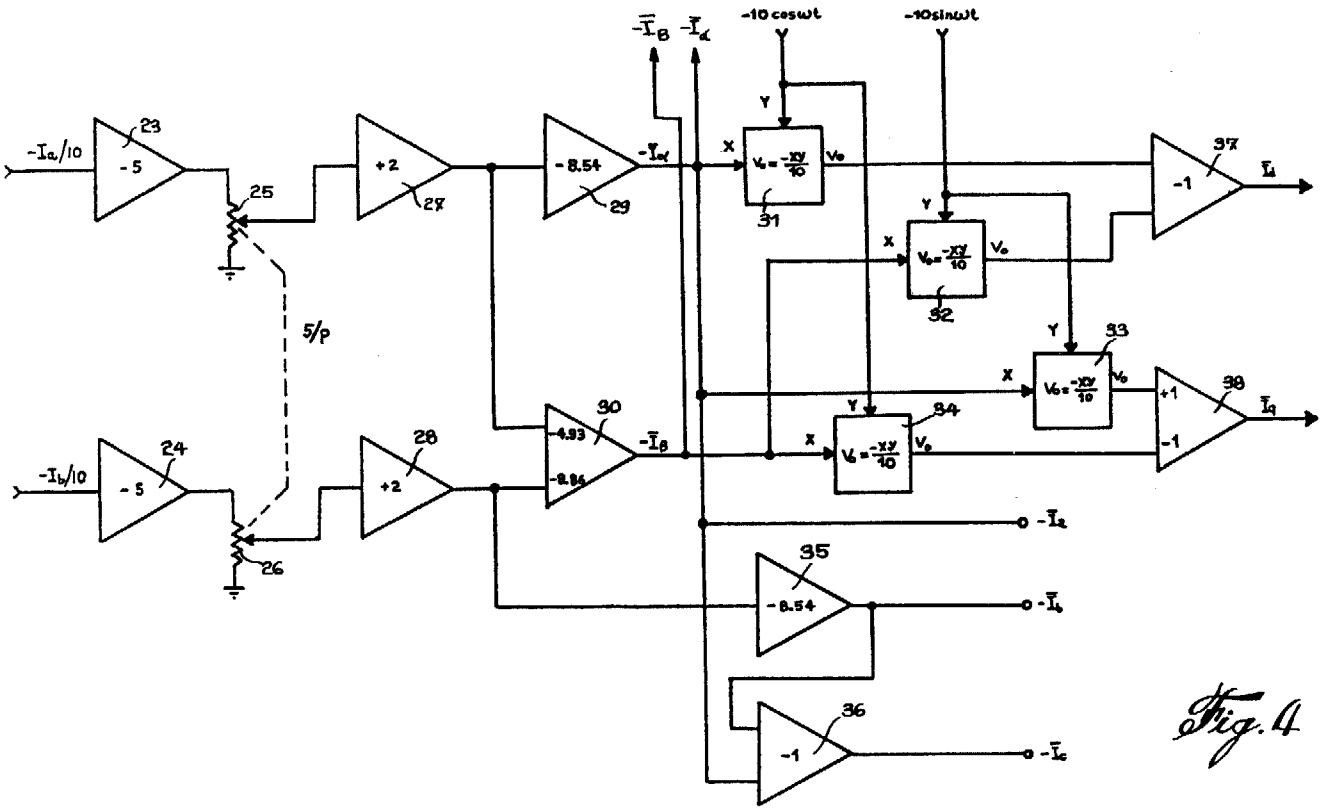
FIG. 4 shows a circuit for transforming the axes of the currents.

A capacitive coupling $C_1$ and $C_2$ is set at each output of the oscillator to get rid of all low DC voltage fluctuations which could occur at the respective output of the two integrators 11 and 12. Usually, those low fluctuations in voltage appear when the frequency varies and with the aging of the circuit and, if they are not isolated, they may produce a change in the operation point of the multipliers used for the axes transformations (FIG. 4). The cut-off frequency of the capacitive coupling is of 0.22 Hz and this for the purpose of avoiding any amplitude and phase error during substantial variations in the frequency.

The amplifiers 21 and 22 used at each of the outputs of the oscillator permit to adjust the respective amplitude of the oscillations at a predetermined level.

AXIS TRANSFORMATION CIRCUIT

The sinusoidal and cosinusoidal signals issued from the oscillator illustrated in FIG. 3 serve to feed an axis transformation unit as applied to the armature currents of the machine (unit 2 of FIG. 2). That transformation unit is shown in detail in FIG. 4 and analogically realizes the above relation 3 by transforming the three-phase currents into two-phase currents while using the fact that the sum of the three armature currents cancel each other. That circuit also carries out the above relation 4 relative to the transformation of the two-phase currents into currents following axes D and Q. Thus, from those armature currents $I_a$ and $I_b$, the direct axis and quadrature axis currents $\overline{I}_d$ and $\overline{I}_q$ are defined by means of that circuit in addition to the armature currents $\overline{I}_a$, $\overline{I}_b$ and $\overline{I}_c$ in relative values.

In view of the absence of homopolar currents across the terminals of the machine, when the latter operates as a generator or a synchroneous compensator, since the neutral of the armature connected in Y, has a common point grounded through an impedance which has an infinite value in practice, the sum of the three armature currents being then nul, it becomes sufficient to measure only the currents of phases A and B designated by $I_a$ and $I_b$. Also, only those two currents are used for feeding the axes transformation circuit of FIG. 4.

Each of the currents $I_a$ and $I_b$ is first amplified through an amplifier 23, 24, a portion of the output voltage of which is sampled by means of the potentiometers 25 and 26 that in fact determine the base power P of the machine. The value of the current $\bar{I}_\alpha$ is determined by amplifying the output of potentiometer 25 through the insulating amplifiers 27 and 29, whereas the current $\bar{I}_\beta$ is determined by adding the output of amplifier 27 and that of an amplifier 28 connected to the potentiometer 26 through the adder 30.

Currents $\bar{I}_\alpha$ and $\bar{I}_\beta$ being known, it is therefore possible to determine the direct axis and quadrature axis currents. Thus, the current $\bar{I}_d$ is found out by adding the current $\bar{I}_\alpha$, the latter being multiplied by the cos $\omega\tau$ function generated by the oscillator of FIG. 3, to the current $\bar{I}_\beta$ after multiplication by the sin $\omega\tau$ also generated by that oscillator. The multipliers 31 and 32 connected to the adder 37 carry out these multiplication and addition operations. The quadrature axis current $\bar{I}_q$ is similarly obtained, except that in this case the current $\bar{I}_\alpha$ is multiplied by the sin $\omega\tau$ signal whereas the current $\bar{I}_\beta$ is multiplied by the cos $\omega\tau$, respectively through the multipliers 33 and 34. The outputs of these multipliers are added by means of the differential adder 38 which delivers the signal $\bar{I}_q$ desired. The use and the arrangement of multipliers 31 to 34 and of adders 30, 37 and 38 achieve well the above-mentioned relation 4.

The circuit of FIG. 4 also allows to obtain the outputs $\bar{I}_a$, $\bar{I}_b$ and $\bar{I}_c$ which are used as measurement points. $\bar{I}_a$ is directly obtained from $\bar{I}_\alpha$, whereas $\bar{I}_b$ is obtained by amplifying the output of the amplifier 28 by means of the amplifier 35. $\bar{I}_c$ is of course determined by simply adding currents $\bar{I}_a$ and $\bar{I}_b$ through the adder 36. According to the gain of the amplifiers used, those three currents, in relative values, are determined by the following relations:

$$\left.\begin{aligned} \overline{I_a} &= 8.54\left(\frac{I_a}{10}\right)\left(\frac{50}{P}\right) \\ \overline{I_b} &= 8.54\left(\frac{I_b}{10}\right)\left(\frac{50}{P}\right) \\ \overline{I_c} &= -\left(\overline{I_a} + \overline{I_b}\right) \end{aligned}\right\} \quad (22)$$

where P=base power.

As mentioned above, the base power is found out from the voltage value on each of the potentiometers 25 and 26. In order to obtain a versatility in the operation of the electronic simulator, each generating unit can operate through a base power comprised between 5 to 50 watts, the highest power being chosen so as to be in agreement with any direct current simulator developing a voltage of 100 volts R.M.S. line-to-line through the secondary of the transformer of a real generator.

In view of the limits imposed by the power amplifiers, as will be seen further on, the machine voltage has been set at 21.21 volts R.M.S. per phase. Thus, the machine base current varies from 82.8 mA R.M.S. to 828 mA R.M.S., when a base power factor of 0.95 is selected.

MUTUAL FLUX GENERATOR

Figure 5:
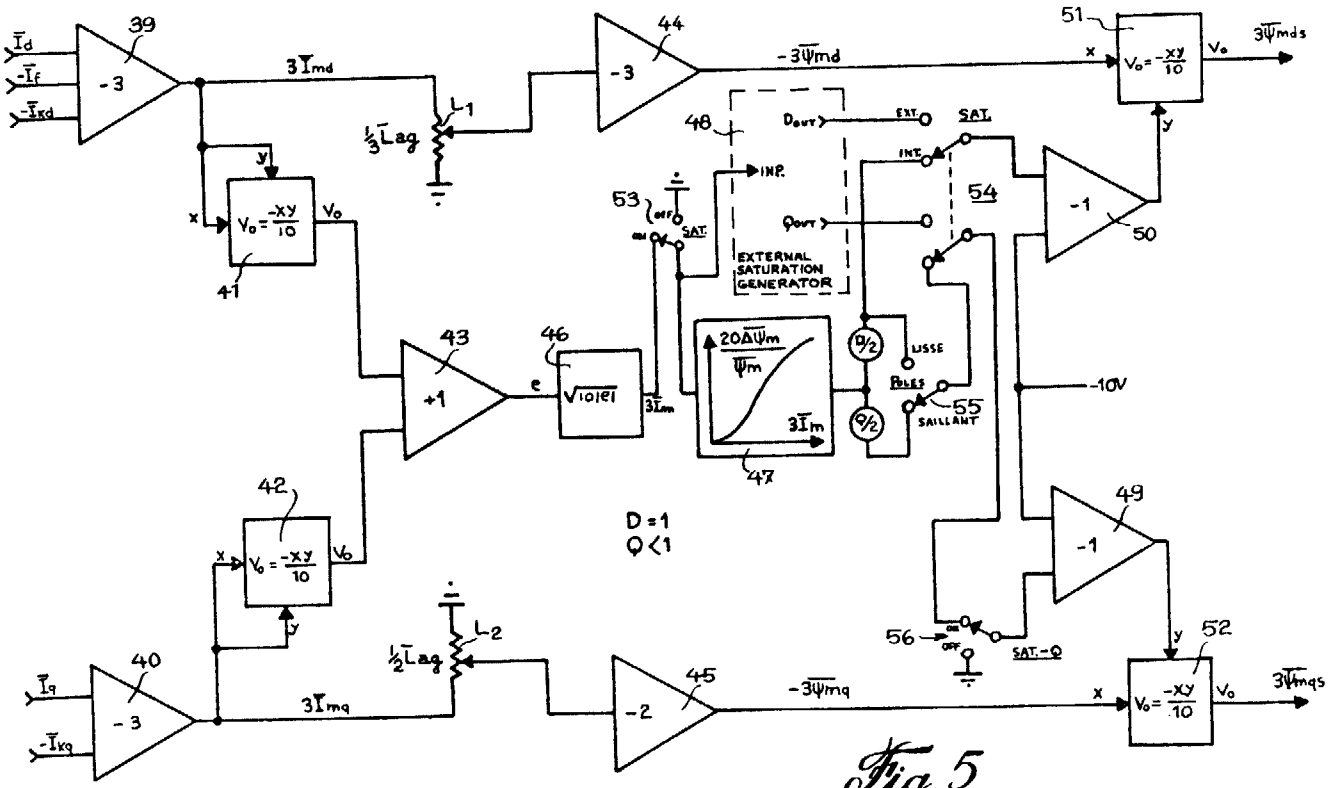
FIG. 5 illustrates a circuit for generating the mutual saturation flux of the machine.

The mutual saturated flux $\overline{\Psi}_{mds}$ and $\overline{\Psi}_{mqs}$ determined from the relations 21*r* and 21*s* are achieved by the generator illustrated in FIG. 5 and which is designated by reference 3 at FIG. 2. Since these mutual flux of saturation are directly proportional to the mutual flux which are function of the magnetomotive forces in the rotor windings, this generator has to be further fed with the direct axis and quadrature axis currents and with those flowing to the field windings and the damper windings in the direct axis and the quadrature axis ($\bar{I}_f$, $\bar{I}_{kd}$ and $\bar{I}_{kq}$, respectively), so as to achieve equations 21*m* and 21*n*. Those rotor currents are produced by generator 4 of FIG. 2 which will be described hereon.

The magneto-motive force $\bar{I}_{md}$ is obtained by adding the currents $\bar{I}_d$, $\bar{I}_f$ and $\bar{I}_{kd}$ by means of the adder-amplifier-invertor 39 whereas the current $\bar{I}_{mq}$ is obtained by adding the currents $\bar{I}_q$ and $\bar{I}_{kq}$ through the adder-invertor-amplifier 40, thereby achieving relations 21*m* and 21*n*. The value of those two magneto-motive forces is sampled by means of the variable potentiometers $L_1$ and $L_2$ which has a relative value proportional to the mutual inductance $\bar{L}_{ad}$ and $\bar{L}_{aq}$ in the direct axis and the quadrature axis, respectively. Following amplification and inversion through the respective amplifiers 44 and 45, there are obtained the mutual flux $\overline{\Psi}_{md}$ and $\overline{\Psi}_{mq}$, this being in conformity with equations 21*p* and 21*q* mentioned above.

To obtain the resulting magneto-motive force $\bar{I}_m$ necessary for the determination of the saturated mutual flux, the forces $\bar{I}_{md}$ and $\bar{I}_{mq}$ are respectively squared by the multipliers 41 and 42, and thereafter added through the adder 43 the output of which is connected to the square root extractor 46. Such an operation results in the achievement of equation 21*o*. That resulting magneto-motive force $\bar{I}_m$ feeds either a saturation generator 48 exteriorly incorporated into the present simulation system, or an internal saturation generator 47 whose output signal represents the variation in the relative flux in relation to that resulting magneto-motive force, the switch 54 permitting to chose either one of those two saturation generators.

To simulate smooth-pole or radial-pole rotating machines, the output of generator 47 is multiplied by the D and Q coefficients called the saturation coefficients along the direct axis and the quadrature axis respectively (see equation 20). The value of Q, determined from most works effected on radial-pole generating machines, is set at 0.2 whereas the value of D is 1. In the case of smooth-pole machines, those two values are the same and equal to 1. Therefore, according to the type of machine to be simulated, the switch 55 is set onto either one of the appropriate corresponding contacts.

The so-determined value of the saturation rate is thereafter inverted by the inverters 49 and 50 and multiplied to the mutual flux of the direct axis and quadrature axis by the multipliers 51 and 52 respectively. Thus, there are obtained the relative values of the mutual saturated flux along those two axes.

By means of the generators of FIG. 5, it is also possible to simulate any type of alternators, synchronous compensators as well as induction and snychronous motors, and to eliminate either all saturation by means of the switch 53, or the quadrature saturation only through the switch 56.

ROTOR CURRENTS GENERATOR

As mentioned in the description of FIG. 5, it is necessary to introduce currents $\bar{I}_f$, $\bar{I}_{kd}$ and $\bar{I}_{kq}$ at the input of the generator producing the mutual saturated flux $\overline{\Psi}_{mds}$ and $\overline{\Psi}_{mqs}$, these currents flowing respectively through the field windings and the damper windings of the direct axis and the quadrature axis. The generator circuit illustrated in FIG. 6 functions to deliver the wanted rotor currents, this generator being looped onto the generator of FIG. 5 (see FIG. 2).

Figure 6:
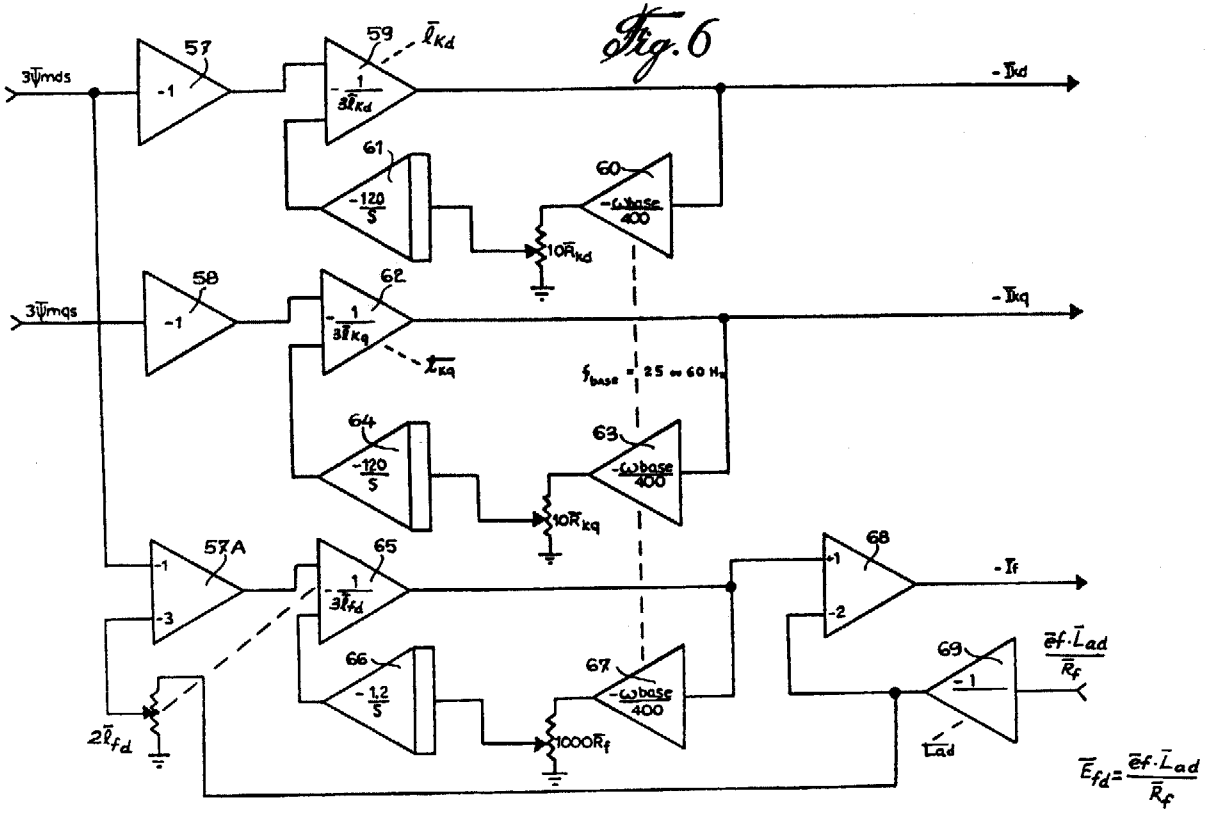
FIG. 6 shows a circuit for generating currents of the dampers and the fields equivalent to those present in an actual machine.

The generator circuit of FIG. 6 achieves an analogic simulation of the relations 21d, 21e, 21f, 21j, 21k and 21l given above. However, rather than simulating those relations directly, which would require the use of analogic integrators, a recombination of those will result in simplifying the corresponding electronic set-up. Thus, combining 21d with 21j, we obtain $$\overline{I_f} = \frac{\overline{e_f}}{\overline{R_f}\left(1 + \frac{P\overline{I_{fd}}}{\omega_{base}\,\overline{R_f}}\right)} - \frac{P\overline{\psi_{mds}}}{\omega_{base}\,\overline{R_f}\left(1 + \frac{P\overline{I_{fd}}}{\omega_{base}\,\overline{R_f}}\right)} \tag{23}$$

combining 21e with 21k, we obtain $$\overline{I_{kd}} = -\frac{P\overline{\psi_{mds}}}{\omega_{base}\,\overline{R_{kd}}\left(1 + \frac{P\overline{I_{kd}}}{\omega_{base}\,\overline{R_{kd}}}\right)} \tag{24}$$

and combining 21f with 21l, we obtain $$\overline{I_{kq}} = -\frac{P\overline{\psi_{mqs}}}{\omega_{base}\,\overline{R_{kq}}\left(1 + \frac{P\overline{I_{kq}}}{\omega_{base}\,\overline{R_{kq}}}\right)} \tag{25}$$

where $\overline{I_f}$, $\overline{I_{kd}}$ and $\overline{I_{kq}}$ designate respectively the leakage inductance of the field and of the damper in the direct and quadrature axes.

Those three new relations 23, 24 and 25 thereby allow to simulate the rotor currents and this without the use of analogic integrators.

Then, referring to FIG. 6, the generator circuit receives through two separate inputs the mutual saturated flux $\overline{\Psi}_{mds}$ and $\overline{\Psi}_{mqs}$ which are respectively inverted by the inverters 57 and 58. The output of inverter 57 is added through adder 59 to a signal delivered by a feedback circuit formed by amplifier 60 the output of which is sampled by the variable resistance $\overline{R}_{kd}$ (the resistance of the direct axis damper) and thereafter integrated through integrator 61, thereby achieving the relation 24.

Similarly, the current $\overline{I}_{kq}$ is simulated by adding the output of inverter 58 to a signal delivered by a feedback loop formed by amplifier 63 the output of which is connected to integrator 64 through a variable resistor $\overline{R}_{kq}$, the latter resistor corresponding to the relative resistance of the damper along the quadrature axis. The above relation 25 is thus achieved.

The simulation of the field current $\overline{I}_f$ (equation 23) is realized by applying, through the input of the adder-inverter 57A, the field $\overline{\Psi}_{mds}$ and a signal proportional to the field voltage $\overline{E}_{fd}$ equivalent to that produced by an exciter, that field voltage being amplifed and inverted in 69 and thereafter sampled by a variable potentiometer having a value proportional to the leakage inductance of field $\overline{I}_{fd}$. The output of adder 57A is then added to a signal delivered by a feedback loop constituted of amplifier 67 the output of which is connected to the integrator 66 through the variable resistance $\overline{R}_f$, the latter resistance being the field resistance of the machine. Finally, a differential adder 68 adds the output of the adder 65 to that of amplifier 69 to produce the desired field current $\overline{I}_f$. It is to be noted that in FIG. 6, the exciting voltage $\overline{E}_{fd}$ is utilized rather than $\overline{e}_f$ used in relation 23, because of the configuration generally used for the exciters in the case of generators.

It is to be noted that the value shown inside each of the circuits 65, 59, 62 and 69 represents its respective transfer function and corresponds to the leaked inductance of the field, of the damper in the direct axis, of the damper in the quadrature axis and of the mutual inductance in the direct axis, each being of course mounted variable according to the type of machine to be simulated. Also, it is noted that the base frequency of the amplifiers 60, 63 and 67 may be of 25 or 60 Hz.

TOTAL SATURATED FLUX GENERATORS

Figure 7:
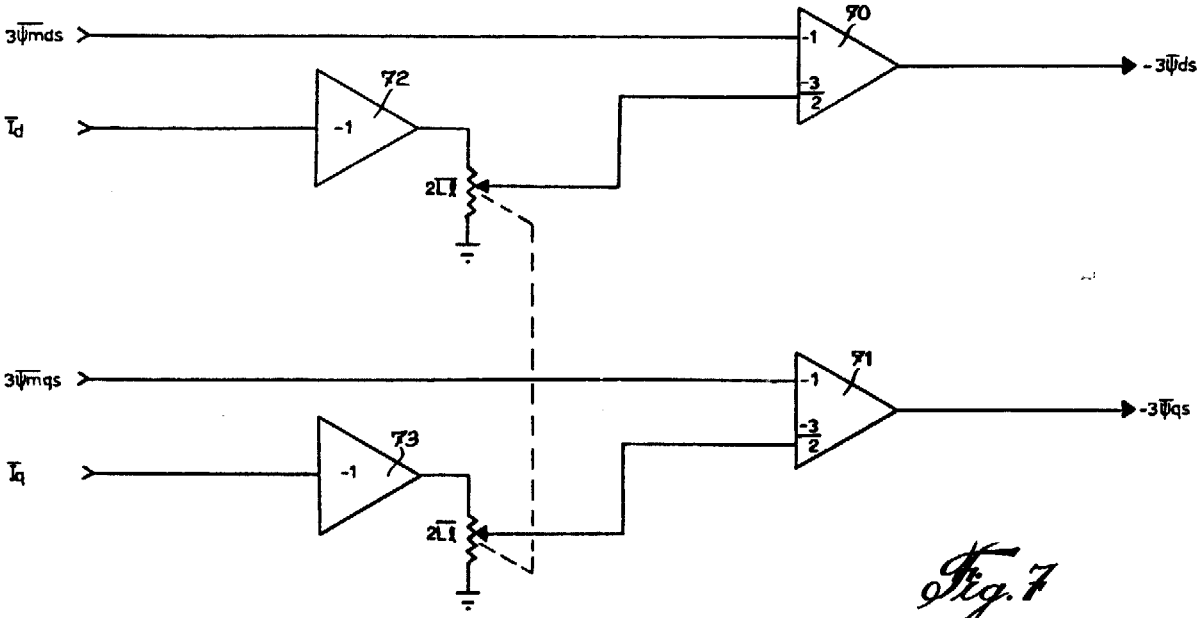
FIG. 7 illustrates a circuit for generating the total saturated flux.

The generating circuit illustrated in FIG. 7 delivers the total saturated flux $\overline{\Psi}_{ds}$ and $\overline{\Psi}_{qs}$, according to the direct and quadrature axes, respectively. Indeed, these flux correspond to the armature leakage flux of a real machine simulated according to the D and Q axes, which are mathematically represented by the relations 21g and 21h above. Pursuant to these relations, the mutual saturated flux $\overline{\Psi}_{mds}$ and $\overline{\Psi}_{mqs}$ produced by the generating circuit of FIG. 5 are respectively added through the adders 70 and 71 to the currents $\overline{I}_d$ and $\overline{I}_q$ as inverted by the invertors 72 and 73 and thereafter sampled by the variable potentiometers of value $\overline{L}_1$, the latter value corresponding to the armature leakage inductance in relative value. The respective outputs of adders 70 and 71 represent the flux $\overline{\Psi}_{ds}$ and $\overline{\Psi}_{qs}$ desired.

D AND Q VOLTAGES GENERATOR

Figure 8:
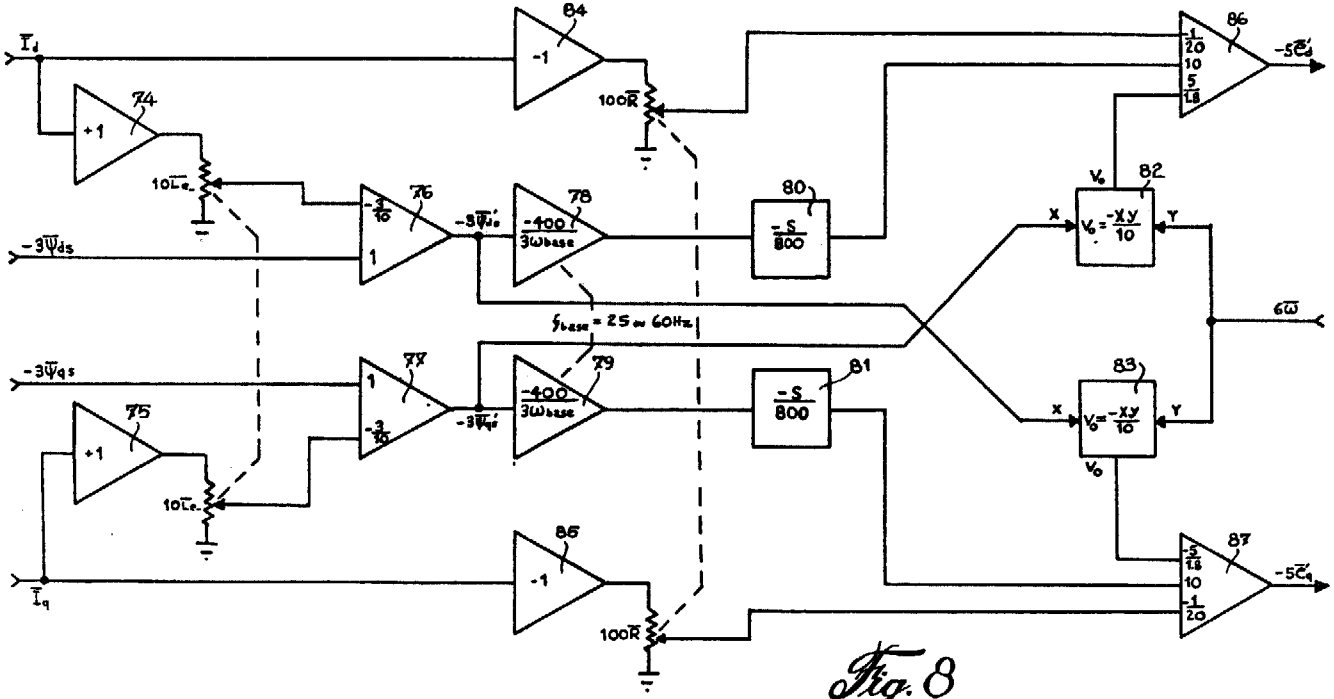
FIG. 8 depicts a circuit for generating the armature voltages and a simulation of the armature negative inductance.

The total saturated flux $\overline{\Psi}_{ds}$ and $\overline{\Psi}_{qs}$ being known, it is possible to determine, by means of the arrangement shown in FIG. 8, the voltages $\overline{e}_d$ and $\overline{e}_q$ which correspond to the voltages across the terminals of the direct and quadrature axes, respectively. The values of these voltages are theoretically represented by equations 21a and 21b.

It is to be noted that the generating circuit of FIG. 8 advocates the use of a negative inductance $\overline{L}e-$, called the armature negative inductance, and because of its presence, the total saturated flux $\overline{\Psi}_{ds}$ and $\overline{\Psi}_{qs}$ have to be transformed before being utilized adequately in equations 21a and 21b. The reason for using a negative inductance $\overline{L}e-$ will be explained later on in the instant text. Modified total saturated flux $\overline{\Psi}_{ds}$ and $\overline{\Psi}_{qs}$ are then produced by adding the current $\overline{I}_d$, which flows through the insulator 74 and the negative inductance $\overline{L}e-$, to the flux $\overline{\Psi}_{ds}$ by means of the adder 76; similarly, the current $\overline{I}_q$ which flows through the insulator 75 and the armature negative inductance $\overline{L}e-$ is added to the flux $\overline{\Psi}_{qs}$ by means of the adder 77. Those flux are then expressed as follows:

$$\overline{\Psi}'_{ds} = \overline{\Psi}_{ds} + \overline{L}e - \overline{I}_d \tag{26}$$

$$\overline{\Psi}'_{qs} = \overline{\Psi}_{qs} + \overline{L}e - \overline{I}_q \tag{27}$$

The flux $\overline{\Psi}'_{ds}$ is then amplified through amplifier 78 and integrated through integrator 80. On the other hand, the current $\overline{I}_d$ is inverted in invertor 84 and sampled by the armature resistance $\overline{R}$, whereas the modified flux $\overline{\Psi}'_{qs}$ is multiplied by $\overline{\omega}$, which corresponds to the angular speed of a turbine, by means of the multiplier 82. The outputs of the resistance $\overline{R}$, of the integrator 80 and the multiplier 82 are then linked to the inputs of the differential amplifier 86 which delivers a voltage $\overline{e}+_d$ which well corresponds to that defined in equation 21a, when the existence of the negative inductance $\overline{L}e-$ is taken into account.

Similarly, the quadrature voltage $\overline{e}'_q$ is obtained by adding, through the differential amplifier 87, the outputs of multiplier 83, which also multiplies $\overline{\Psi}'_{ds}$ by $\overline{\omega}$, of the integrator 81, which integrates the flux $\overline{\Psi}'_{qs}$ previously amplified by the amplifier 79, as well as the current $\overline{I}_q$ inverted by 85 and sampled by the armature negative resistance $\overline{R}$. Here again, the value of the quadrature voltage $\overline{e}'_q$ corresponds to that defined in relation 21b, while taking into account the existence of the negative inductance $\overline{L}e-$.

Figure 10:
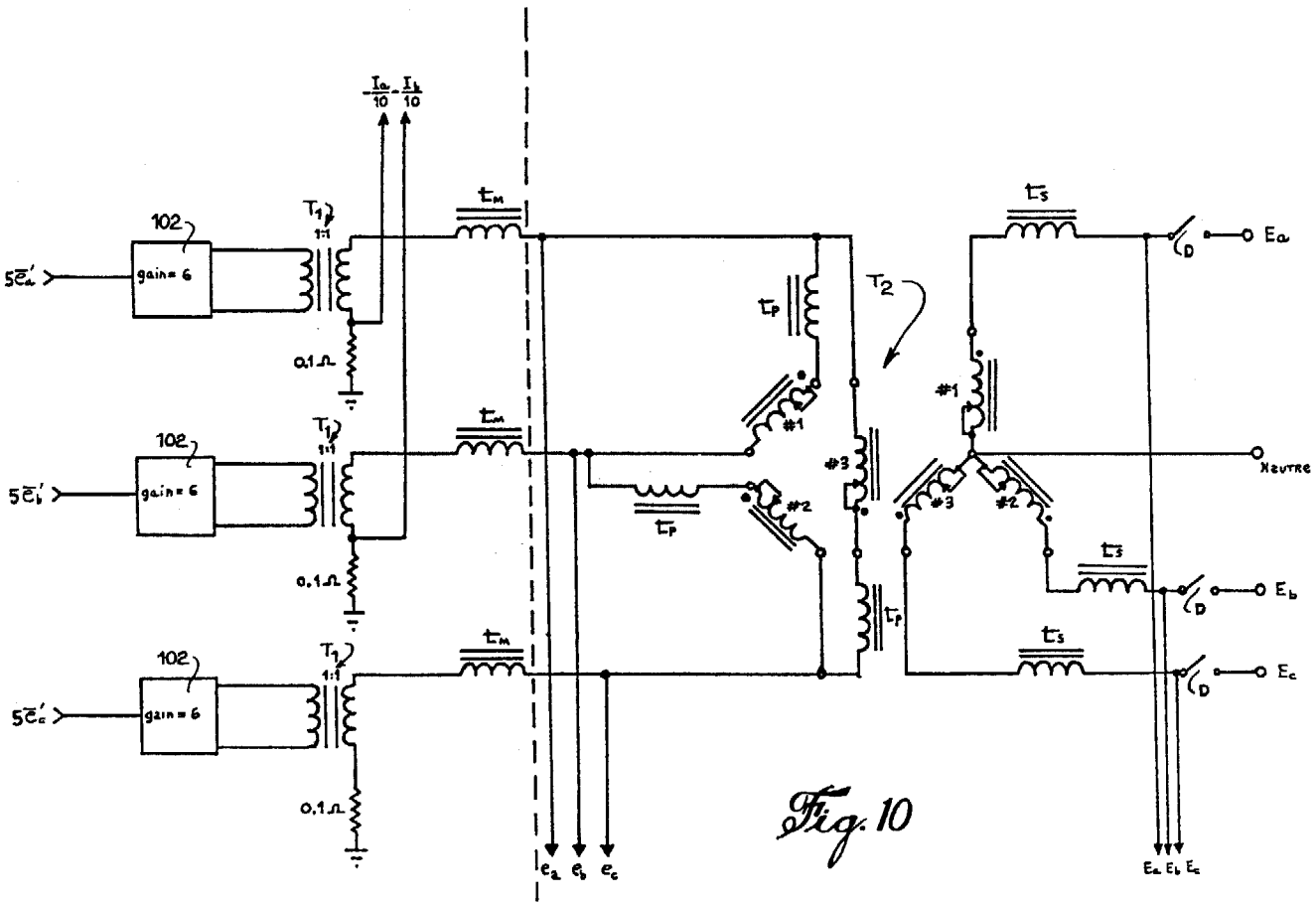
FIG. 10 represents a circuit for connecting power amplifiers, insulating transformers, an armature inductance and an electrical netwok transformer.

Concerning the armature negative inductance $\overline{L}e-$, its use is necessitated due to the insertion of an inductance $\overline{L}_m$, called the armature physical inductance, in the arrangement of FIG. 10. The existence of such an armature physical inductance $\overline{L}_m$ offers indeed true advantages in the present simulator. Indeed, it is to be noted that the simulation of the armature leakage inductance imposes the use, in the simulator of the machine, of analogic generators which generate an enormous amount of noise when their passband is not limited. Additionally, the gain of the overall system in open loop, that is when the current generators are disconnected, becomes substantial with such a large passband integrator and when the base power is about 5 watts, since then the various measured currents are amplified by 10 instead of by 1. In this case, the stability of the system is not easily maintained, particularly when operational amplifiers of a low cost are used. Moreover, without that inductance $\overline{L}_m$, it is very difficult to realize short circuit tests, in the case of a generator, since then the closed loop gain due to the load impedance becomes extremely large.

Consequently, the use of an armature physical inductance $\overline{L}_m$ (FIG. 10) allows to reduce the passband of the analogic differentiator, this physical inductance having an extremely high upper limit frequency, and hence to reduce the noise generated as well as to substantially diminish the gain of the closed loop overall system when the load is a short circuit, thereby allowing an analysis of any short circuit across the terminals of the armature of a generator without oscillating effects, while utilizing low-cost amplifiers. As a result, the impedance of the generator viewed from its terminals may be correctly represented up to the 25th harmonic of the main frequency, thereby offering an adequate simulation when the generator feeds a direct current rectifier without any AC filter and also permitting a fair showing of working overvoltages.

The value of the negative inductance $\overline{L}e-$ is therefore selected so as to cancel the armature physical inductance $\overline{L}_m$ of the simulator. It is also to be noted that the base frequency, particularly that of the amplifiers 78 and 79, may be chosen equal to 25, 50 or 60 Hz.

THREE-PHASE VOLTAGE GENERATOR

The direct axis and quadrature axis voltages $\overline{e}'_d$ and $\overline{e}'_q$, respectively, being known, there may be then determined the voltages $\overline{e}'_a$, $\overline{e}'_b$ and $\overline{e}'_c$ (or $\overline{e}_a$, $\overline{e}_b$ and $\overline{e}_c$, if the physical inductance $\overline{L}_m$ is not considered) which respectively correspond to the voltages across the terminals of the machine windings. For that purpose, the circuit of FIG. 9 effects a transformation of the two-phase axes to three-phase axes according to the following relations:

$$\begin{bmatrix} \overline{e_\chi} \\ \overline{e_\beta} \\ \overline{e_o} \end{bmatrix} = \begin{bmatrix} \cos\theta & -\sin\theta & 0 \\ \sin\theta & \cos\theta & 0 \\ 0 & 0 & 1 \end{bmatrix} \begin{bmatrix} \overline{e_d} \\ \overline{e_q} \\ \overline{e_o} \end{bmatrix} \tag{28}$$

$$\begin{bmatrix} \overline{e_a} \\ \overline{e_b} \\ \overline{e_c} \end{bmatrix} = \begin{bmatrix} 1 & 0 & 1 \\ -\frac{1}{2} & \frac{\sqrt{3}}{2} & 1 \\ -\frac{1}{2} & -\frac{\sqrt{3}}{2} & 1 \end{bmatrix} \begin{bmatrix} \overline{e_\alpha} \\ \overline{e_\beta} \\ \overline{e_o} \end{bmatrix} \tag{29}$$

In these equations, the voltages $\overline{e}_\alpha$ and $\overline{e}_\beta$ designate the armature voltages of the phases $\alpha$ and $\beta$ respectively in the two-phase equivalent system.

It is noted that the equations 28 and 29 do not take into account the use of an armature negative resistance $\overline{R}=$, the reason being given later on. But, in any case, the circuit of FIG. 9 well respects the values theoretically determined by relations 28 and 29.

Thus, the voltage $\overline{e}'_d$ is added to $\overline{I}_d\overline{R}-$ whereas the voltage $\overline{e}'_q$ is so to $\overline{I}_q\overline{R}-$ by means of the respective adders 90 and 91. The output of adder 90 feeds two multipliers 92 and 95 which multiply the signal by cos $\omega\tau$ and sin $\omega\tau$ respectively, these two functions being generated by the oscillator illustrated in FIG. 3. On the other hand, the output signal from the adder 91 supplies two multipliers 93 and 94 to effect its multiplication by the functions sin $\omega\tau$ and cos $\omega\tau$ respectively. The voltage $\overline{e}'_\alpha$ is then obtained by adding the outputs of multipliers 92 and 93 through the differential adder 96 whereas the voltage $\overline{e}'_\beta$ is obtained by adding the outputs of multipliers 94 and 95 in the adder 97. The resulting values of $\overline{e}'_\alpha$ and $\overline{e}'_\beta$ therefore correspond to those defined in the matrix of equation 28, without regard to the existence of the armature negative resistance R−.

Thereafter, the voltage $\overline{e}'_a$ is directly obtained from $\overline{e}'_\alpha$; the voltage $\overline{e}'_b$ is obtained by adding the voltages $\overline{e}'_\alpha$ and $\overline{e}'_\beta$ by means of the differential adder 100 and after having been respectively amplified by the amplifiers 98 and 99; and finally the voltage $\overline{e}'_c$ results from the addition in adder 101 of the voltages $\overline{e}'_\alpha$ and $\overline{e}'_\beta$ which have been respectively amplified by the amplifiers 98 and 99. The gain of amplifiers 98 and 99 corresponds of course to the terms in the matrix of equation 29. Therefore, the transformation circuit of FIG. 9 permits to determine the voltages $\overline{e}'_a$, $\overline{e}'_b$ and $\overline{e}'_c$ which in fact represent the three-phase voltages across the terminals of the machine, which voltages immediately precede the physical inductance $\overline{L}_m$ of the simulator and which take into account the existence of the armature negative resistance R−.

It is to be said here that the armature negative resistance R− is added in order to compensate and to cancel the various resistances inserted into the simulation circuits and which correspond to those of the physical inductance $\overline{L}_m$ (FIG. 10), of the insulation transformer (FIG. 10), of the breaker and of a resistance associated with the current in the armature physical circuit. Moreover, the equivalent resistance of the high voltage transformer (FIG. 10), which is a transformer equivalent to that used at the output of a generator in a real network, may in some cases be larger than that given by the manufacturer. Thus, the negative resistance R− acts as a means to cancel electronically, inside the simulator all the unwanted resistances.

Figure 9:
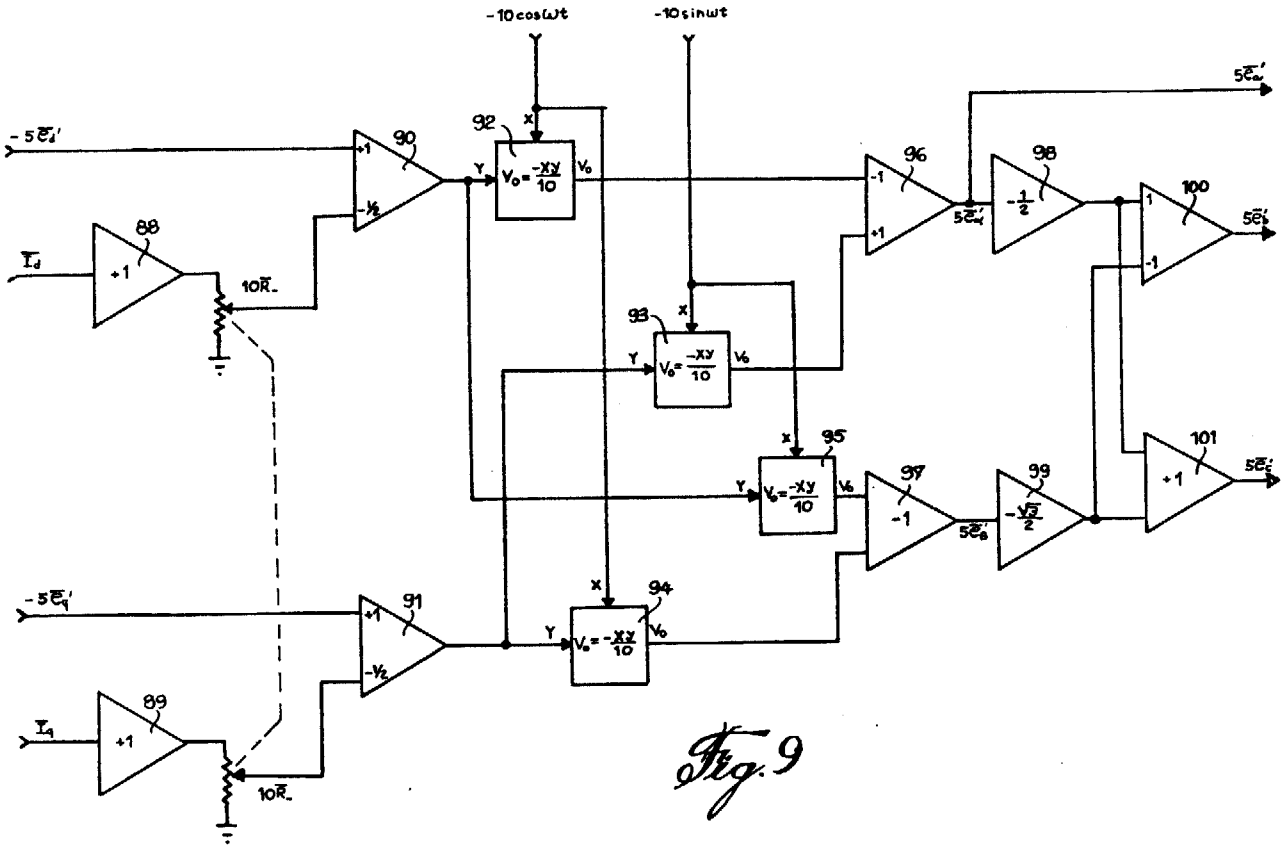
FIG. 9 shows a circuit for transforming the diphase voltages into three-phase voltages and the simulation of the armature negative resistance.

It is to be noted, in FIG. 9, that two unitary gain amplifiers 88 and 89 are illustrated, those amplifiers acting as insulators.

POWER AMPLIFIERS AND NETWORK TRANSFORMER

Referring to FIG. 10, the three generated voltages $\bar{e}'_a$, $\bar{e}'_b$ and $\bar{e}'_c$ are initially amplified in voltage and in power by the power amplifiers 102 respectively. Those amplifiers 102 allow an overvoltage of 100% across the terminals of the machine utilized as a generator when the latter operates at no-load, and an overvoltage of 50% in the case where the load is entirely inductive, when the value of the physical inductance $\bar{L}_m$ equals its maximum value of 10% and when the low voltage is of 1.12PU (at rated current). The choice of the amplifiers allows to represent well the dynamic over-voltages of any type of problems to be analyzed in connection with the behavior of any type of generator. Moreover, the amplifiers 102 are selected so as to permit a flow of currents of approximately 12PU, during short circuits, across the terminals of the generator.

In addition, the defects in the multipliers used in the achievements of the axes transformations of the voltages, delivered to their respective outputs an inadequate image of the voltages $\bar{e}'_d$ and $\bar{e}'_q$ which, in normal operation, are actually direct current voltages. These direct voltages, when amplified, saturate the network transformer $T_2$, if disregarded. To obviate this problem, each power amplifier 102 is connected to the network transformer $T_2$ through an insulating transformer $T_1$ having a unitary turn ratio and which has a saturation level which cannot be reached in practice and which possesses an extremely low leakage inductance and resistance. Moreover, the use of the insulating transformer $T_1$ permits an easy measurement of the armature current since it suffices to insert a low resistance (0.1 ohm) in the secondary circuit of transformers $T_1$ to do so. Those armature currents $\bar{I}_a$ and $\bar{I}_b$ are also utilized to feed the axis transformer of FIG. 4.

It is also to be noted that, due to the low value of the leakage inductance and of the primary resistance of transformers $T_1$, their magnetizing current does not introduce any voltage distortion in the circuit. Each of the insulating transformers $T_1$ is connected to the armature physical inductance $\bar{L}_m$ which has been discussed above in connection with FIG. 8. Therefore, the low voltage values $e_a$, $e_b$ and $e_c$ produced by the generator are determined at the output of the physical inductances.

On the other hand, transformer $T_2$ simulates a real network transformer and operates to transform the low voltages $e_a$, $e_b$ and $e_c$ into the high voltages $E_a$, $E_b$ and $E_c$. Transformer $T_2$ has therefore its primary connected in delta and its secondary connected in star as is usual in real networks. The inductances $\bar{L}_p$ and $\bar{L}_s$ respectively represent the leakage inductances of the network transformers, the maximum value of each inductance being of 12%.

As supplemental information, it is to be said that the magnetic characteristics of the transformer $T_2$ are those of high power transformers made up of silicium steel as the magnetic material and which feature a ratio between the remanent flux density and the magnetisation flux density of about 0.8 and a magnetizing R.M.S. current in the order of 0.6% at the rated supply voltage when the flux density at the saturation knee corresponds to 1.15PU of the rated magnetization flux density. Preferably, transformer $T_2$ is constituted of three toroidal cores the magnetic material of which is "Square Permaloy 80" which provides a BH curve having a ratio of 0.9 between the remanent flux density and the magnetisation density. That transformer represents a magnetizing current of 2.2% (in R.M.S. value) when the saturation knee is fixed at 1.15PU and when the base power is of 50 watts. Also, sectional cores having a lower circumferential value are used when the base power is reduced in order to ensure a rather low magnetizing current.

As explained above, the negative resistance R− may be adjusted so as to eliminate all the resistances inserted in the system by the power amplifiers 102, the protective breakers, the insulating transformers $T_1$, the resistances of the current detectors and of the armature physical inductances $\bar{L}_m$, so as to offer an outstanding simulation of a generator up to its low voltage output terminals. Moreover, where the primary of the transformer is to be simulated with great accuracy in addition to the generator, this permitting for instance to analyze the switching performance of the transformers, then the supplementary value of the resistance due to the leakage inductance $\bar{L}_p$ at the primary of transformer $T_2$ will be added to the value of the negative resistance R−. A typical value of the primary resistance of transformer $T_2$ is of 0.2%. Finally, where an accurate simulation up to the high voltage level is needed, the negative resistance R− will then incorporate the resistances of all leakage inductances of the transformer $T_2$ as well as the resistance of the breakers of network D. A typical value of the total resistance of the network transformer $T_2$ is of 0.4%.

Furthermore, it is to be noted that the homopolar impedance of transformer $T_2$ may be incorporated to the neutral of that transformer and that the breaker of network D may be simulated by means of thyristors so as to allow the opening of each phase at the 0 crossing time of the current. That simulated breaker may additionally be provided with mercury contacts to avoid any voltage drop across its terminals at closing time following its setting into operation by the thyristors.

VOLTAGE MEASUREMENTS

Figure 11:
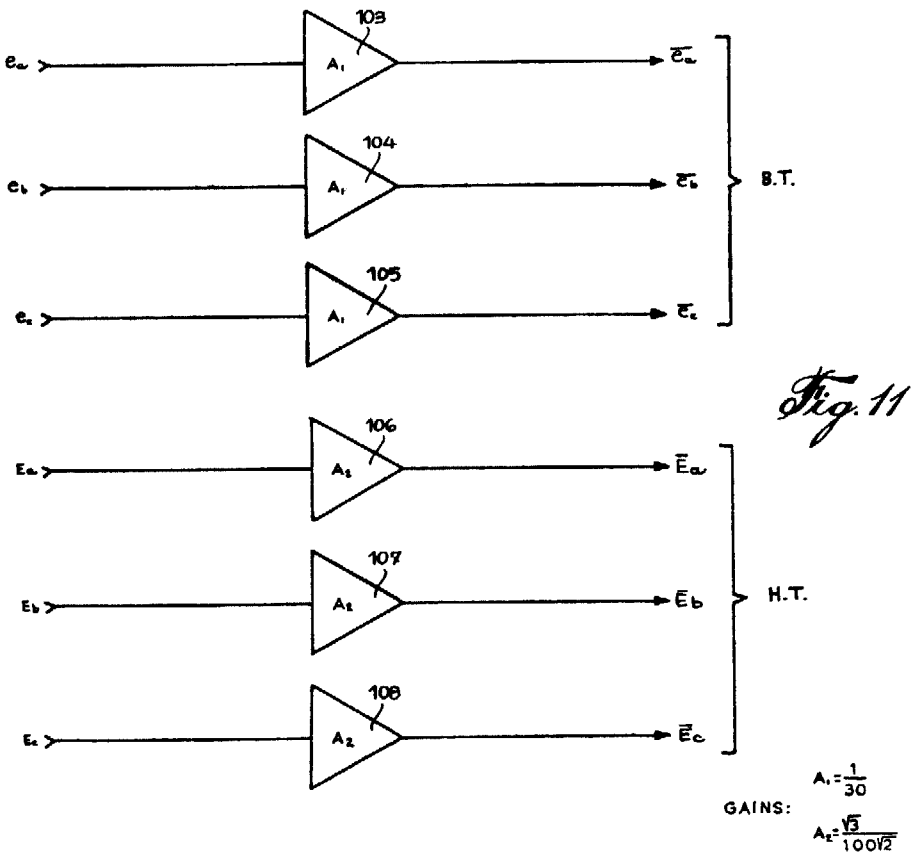
FIG. 11 shows a unit for measuring the low and high three-phase voltages.

FIG. 11 shows an arrangement useful in rendering easy the measurement of the low and high voltages generated by the circuit of FIG. 10. As illustrated, the low voltages $e_a$, $e_b$ and $e_c$ respectively supply the amplifiers 103, 104 and 105 which deliver the relative low voltages $\bar{e}_a$, $\bar{e}_b$ and $\bar{e}_c$. The gain of each of the amplifiers 103, 104 and 105 is the same and of about 1/30.

Similarly, the high voltages $E_a$, $E_b$ and $E_c$ feed the amplifiers 106, 107 and 108, respectively, which develop the voltages $\bar{E}_a$, $\bar{E}_b$ and $\bar{E}_c$. Thus, the gain of the amplifiers 106, 107 and 108 is set at approximately $$\frac{\sqrt{3}}{100\sqrt{2}}.$$

TORQUE AND POWER MEASUREMENTS

Figure 12:
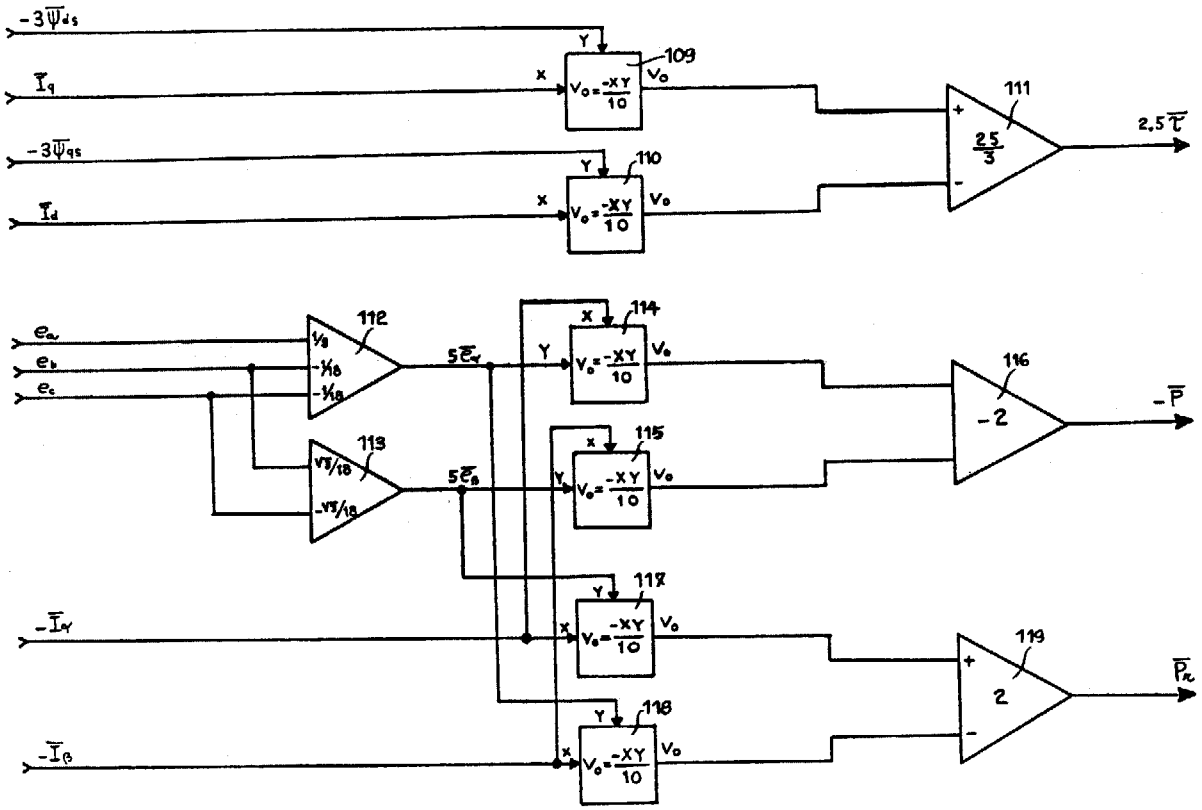
FIG. 12 illustrates a circuit for generating and measuring the torque, the instantaneous and reactive power of the machine.

To know all the characteristics of the simulated machine, it is necessary to measure the value of the electric couple $\bar{\tau}$, which is provided on the shaft of the machine, as well as the value of the instantaneous power $\bar{P}$ and of the reactive power $\bar{P}r$. The relations 21u, 21v and 21w provide a mathematical representation of each of those values and for which a setting up arrangement is illustrated in FIG. 12. As illustrated, the resistive torque $\bar{\tau}$ is obtained by multiplying the total saturated flux $\bar{\Psi}_{ds}$ by the current $\bar{I}_q$ through the multiplier 109, on the one hand, and by multiplying the total saturated flux $\bar{\Psi}_{qs}$ by the current $\bar{I}_d$ through the multiplier 110, on the other hand, the outputs from the multipliers 109 and 110 being then added in the differential adder 111. The result well corresponds to the relation 21u.

To determine the instantaneous power $\bar{P}$, the product $\bar{e}_\alpha$, $\bar{I}_\alpha$ obtained from the multiplier 114 is added to the product $\bar{e}_\beta$, $\bar{I}_\beta$ appearing at the output of multiplier 115, the adding operation being effected by the adder 116. It is noted that the voltage $\bar{e}_\alpha$ may be obtained by adding the voltages $e_a$, $e_b$ and $e_c$ generated by the circuit of FIG. 10 by means of the adder 112, whereas the voltage $\bar{e}_\beta$ is obtained by adding the voltages $e_b$ and $e_c$ through the adder 113.

Also, the reactive power $\bar{P}r$ is obtained by adding the products $\bar{e}_\beta \cdot \bar{I}_\alpha$ and $\bar{e}_\alpha \cdot \bar{I}_\beta$, by means of the differential adder 119, these products being delivered by the multipliers 117, 118, respectively.

It is to be noted that the measurements of the torque and of the instantaneous and reactive powers are rendered easier when the final values obtained through the measurement circuit of FIG. 12 are expressed in relative values, due to the fact that the components of those values have been expressed in relative values at the very beginning.

EXCITER AND STABILIZER

Figure 13:
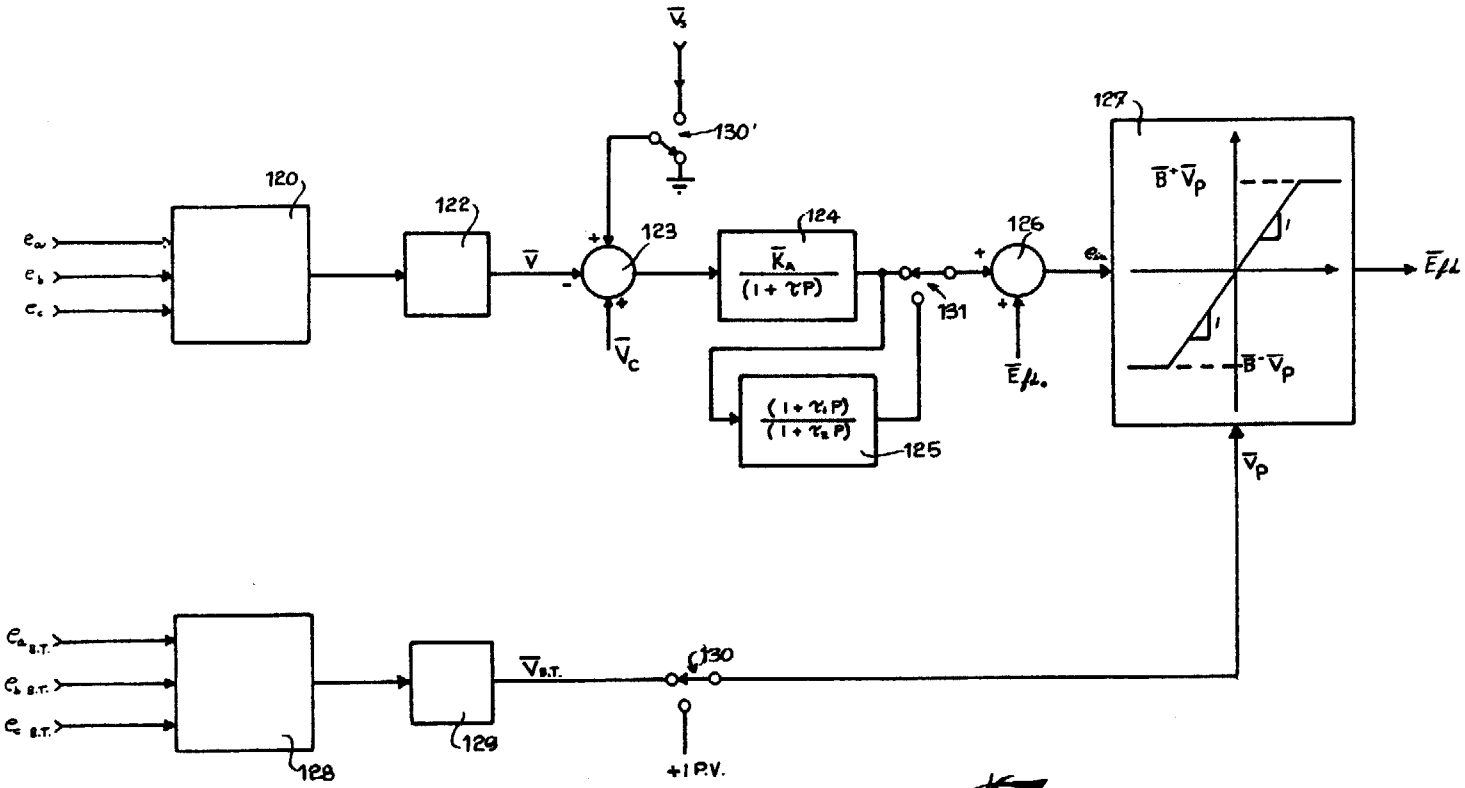
FIG. 13 depicts an analogic model of a static exciter used with a three-phase generator.

In modern hydroelectric plants, the exciters utilized to supply the high power generators are usually of the static or electronic type. There exist several types of static exciters actually on the market, and the fixed type which is provided with thyristors is quite certainly the most popular one. FIG. 13 illustrates an analogic model of that type of static exciter.

In order to simulate as accurately as possible such an exciter, a three-phase configuration, with a possibility of variable gains and peak values, is taken into consideration in the model. Generally, the control voltage $\bar{V}$ may be produced from the low voltages $e_a$, $e_b$ and $e_c$ (machine voltages), or from the high voltages $E_a$, $E_b$ and $E_c$ (network voltages) delivered by the circuit of FIG. 10, or from any other appropriate voltage source. Moreover, it is noted that the exciter maximum voltage $\bar{V}_p$ may be obtained either from the machine voltage which is a variable voltage or from a fixed voltage by means of the switch 130. Finally, to achieve a complete simulation, a correcting element 125 simulating a pole and a zero may be connected in the circuit when needed.

The operation of the analogic model of the static exciter is as follows. The three-phase control voltages $e_a$, $e_b$ and $e_c$ developed by the low voltage, the high voltage or any other arrangement are rectified by the three-phase full wave rectifier 120 formed of six diodes. The resulting direct current voltage is thereafter filtered through the low-pass filter 122 provided with a cut-off frequency of 37Hz and with a damping factor $\delta$ of 0.75. The direct current control voltage $\bar{V}$ is then compared with a reference voltage $\bar{V}_c$ added to a stabilizing voltage $\bar{V}_s$ delivered by the stabiliser unit of FIG. 14, inside the comparator 123. The comparison result is amplified by amplifier 124 having a gain $\bar{K}_A$ and a time constant $\tau$, this time constant corresponding to that of the static exciter. The output of amplifier 124 supplies the adder 126 either directly or through the gain correcting device 125 according to the position of the switch 131. That gain correcting device functions to include a pole and a zero respectively corresponding to the time constants $\tau_1$ and $\tau_2$ to the output signal of the amplifier. The output voltage of the amplifier 124 or of the correcting device 125 feeds the function generator 127 which limits in amplitude the value of the field voltage $\bar{E}_{fd}$ which actually corresponds to a field of the generator.

It is noted that the field voltage $\bar{E}_{fd}$ is limited either positively or negatively by the values $\bar{B}+\bar{V}_p$ and $-\bar{B}-\bar{V}_p$, respectively, $\bar{B}+$ and $\bar{B}-$ defining the maximum positive and negative values in the allowable variation of the voltage $\bar{E}_{fd}$. In the illustrated model, that maximum value may be either variable or fixed, where $\bar{V}_p$ corresponds to the variable voltage $\bar{V}_{BT}$ or the fixed voltage of 1 P.U., according to the selection made by means of the switch 130. The voltage $\bar{V}_{BT}$ is so-called variable since the latter is directly connected to that appearing across the terminals of the generator and it is obtained through the rectification in 128 and the filtering in 129 of the low voltages $e_a$, $e_b$ and $e_c$ generated by the generator. In this case, the rectifier 128 and the filter 129 are identical to the rectifier 120 and the filter 122, respectively. It is noted that the voltage $\bar{V}_{BT}$ is equal to 1 P.U. when the machine voltage is at the rated value.

Finally, it is to be noted that the gain $\bar{K}_A$ of amplifier 124 is chosen so that a variation of 1 P.U. in the field voltage $\bar{E}_{fd}$ is produced when the saturation is not considered and when the voltage $\bar{E}_{fd0}$ represents the load or no-load field voltage of the generator, according to the case. Regarding the stabilization voltage $\bar{V}_s$ which supplies the comparator 123, it may be cancelled by means of the switch 130' to remove the damping effect of the stabiliser.

Figure 14:
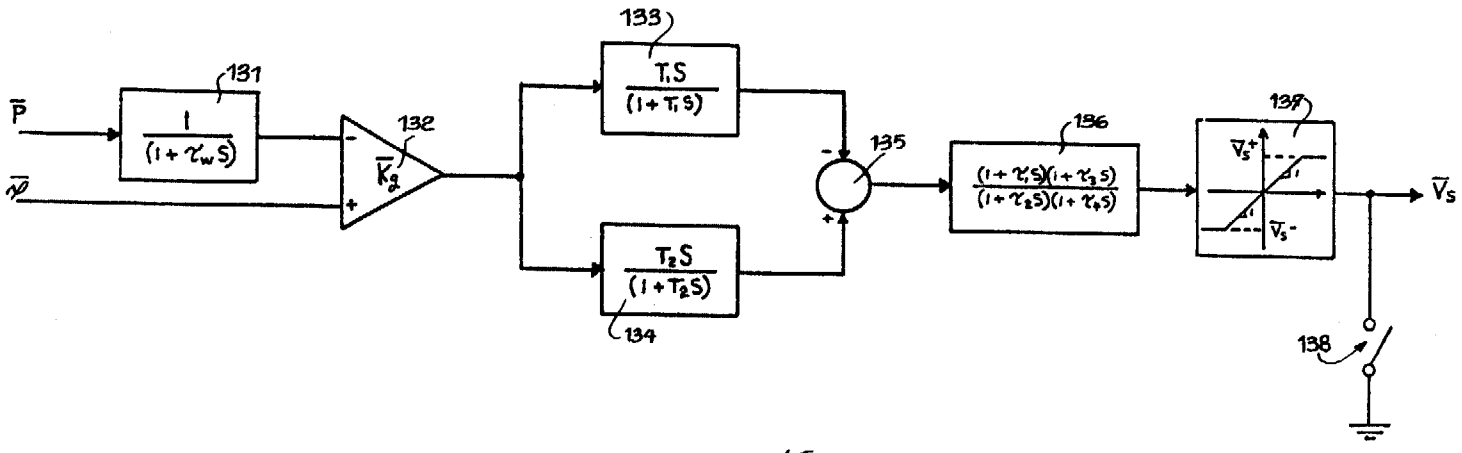
FIG. 14 shows an analogic model of a stabiliser unit.

FIG. 14 illustrates a model of a stabilizing unit, that model permitting an analysis of the stability of alternating current networks in connection with the development of new techniques relative to the damping characteristics of generators. The stabilizer of FIG. 14 develops through its output a control voltage $\bar{V}_s$ which feeds the exciter of FIG. 13 to determine the field voltage $\bar{E}_{fd}$ of the generator in function of the variations in the instantaneous power $\bar{P}$ of that generator and of the position of a gating $\bar{x}$ of a turbine, in the case of a hydroelectric plant. The instantaneous power $\bar{P}$ is first detected by means of a wattmeter 131 having a time constant $\tau_w$, which delivers a position signal which supplies the negative input of a substractor 132, the positive input of which receives a signal concerning the position of the gating $\bar{x}$. That signal $\bar{x}$ is such that the stabiliser will respond to a demand for increasing or decreasing the power from the generator by the network only if the turbine has sufficient time to fulfill that demand, e.g. if the increase or decrease is sufficiently slow. Thus, by means of the substractor 132 having a gain $\bar{K}_g$ corresponding to the integration gain of the stabiliser, the latter is prevented from responding to an increase or a decrease in the generated power by the power control of the speed regulator connected to the turbine. The output of 132 feeds two low-pass filters 133 and 134 connected in parallel and the time constants $T_1$ and $T_2$ of which respectively correspond to the relaxation time and the integration time of the stabiliser. The outputs of those filters are compared in comparator 135 and then corrected by the correcting circuit 136 which is constituted of two phase advancing and delaying transfer functions and serves to render the frequency response curve for the amplitude as well as the phase less dependent of the oscillation frequency. The corrected signal feeds a voltage limiter 137 which functions to limit the stabilizing signal $\overline{V}_S$ in order to exclude the two large amplitude variations in the armature voltages without however damping the large variations in the load angle. Moreover, the stabilizing signal $\overline{V}_S$ may be grounded by means of the breaker 138 when the generator is not synchronized with the network so as to avoid a tendency of the stabilizer to correct the steep variation of the resulting power. But, that grounded signal returns to its normal state after a time corresponding to that taken by the generator to be resynchronized with the network, that time being necessary to prevent the stabiliser from responding to the perturbations produced during the resynchronisation process.

We claim:

1. A system for the analogic simulation of a three-phase rotating machine, comprising first means for transforming the armature currents of the machine into equivalent diphase currents and for transforming said diphase currents into currents along axes called direct and quadrature axes;

means for generating and controlling parameters and characteristics relative to the operation of the machine in response to said direct axis and quadrature axis currents;

means for generating diphase voltages in response to said means for generating and controlling the parameters and the characteristics of the machines;

second means for transforming said diphase voltages into three-phase voltages; and means for generating dynamic characteristics of the machine as a function of said the voltages and of said parameters and characteristics of operation generated by said generating and controlling means.

2. A system as claimed in claim 1, wherein said means for transforming three-phase currents into diphase currents comprise an oscillator unit delivering sinusoidal and cosinusoidal functions which feed an axis transformer unit which converts said diphase currents into said currents along said direct and quadrature axes in function of the value of said sinusoidal and cosinusoidal functions generated by said oscillator unit.

3. A system as claimed in claim 1, wherein said means for generating the parameters and the characteristics of the machine comprise a first unit for generating signals corresponding to rotor currents of said machine in function of signals equivalent to saturation mutual flux of the machine, the latter being generated by a second generating unit which is fed by said direct axis and quadrature axis currents and by said rotor currents for generating said mutual flux, and a third unit for generating signals equivalent to total saturated flux of the machine in response to said mutual saturated flux signals and to said direct axis and quadrature axis currents.

4. A system as claimed in claim 2, wherein said oscillator unit comprises means for stabilizing the frequency and the amplitude of said sinusoidal and cosinusoidal functions, these stabilizing means being controlled by a control voltage corresponding to the angular speed of said machine.

5. A system as claimed in claim 2, wherein the axes transformer unit comprises a first multiplier unit for multiplying each of the diphase currents by said sinusoidal functions of the oscillator unit, a second multiplier unit for multiplying each of the diphase currents by said cosinusoidal functions of the oscillator unit, and an adder unit connected to said first and second multiplier units for generating said direct axis and quadrature axis currents.

6. A system as claimed in claim 2, wherein said axes transformer unit further includes means for determining the base power of said machine.

7. A system as claimed in claim 3, wherein said first generating unit is looped onto said second generating unit, and comprises means for integrating each rotor current and means for adding the integrated currents to said signals equivalent to the mutual saturation flux.

8. a system as claimed in claim 3, wherein said second generating unit comprises means for adding said rotor currents, means for adding said direct axis and quadrature axis currents, means for sampling the output signals from each of said first and second adding means for delivering mutual flux signals, means for determining a saturation rate of said mutual flux, the latter means being connected to each of said first and second adding means, and means for multiplying each of said mutual flux signals by said saturation rate.

9. A system as claimed in claim 8, wherein said means for determining the saturation rate comprise means for squaring corresponding outputs from said first and second adding means, these squaring means being connected to an adder the output of which feeds a square root extractor means, means for generating saturation connected to the output of the square root extractor means and delivering a signal corresponding to said saturation rate to said multiplying means.

10. A system as claimed in claim 9, wherein said saturation generating means comprise means for generating signals corresponding to a saturation coefficient inherent to a simulation of smooth-pole or radial-pole rotating machines.

11. A system as claimed in claim 3, wherein said third generating unit comprises means for adding each of said signals equivalent to the mutual saturated flux to a signal corresponding to said direct axis and quadrature axis currents sampled through a potentiometric element having a value corresponding to the armature leakage inductance of said machine, each of said adding means supplying through its output a signal representative of one of said total saturated flux.

12. A system as claimed in claim 3, wherein said means for generating the phase voltages comprise means for adding each of said signals equivalent to the total saturated flux with the respective direct axis and quadrature axis currents flowing through an armature negative inductance, the output signal from each of said adding means supplying inputs of a summing means through an integrator-multiplier unit for summing signals generated by the latter unit with said direct axis and quadrature axis currents, respectively, when sampled by an element corresponding to the armature resistance of said machine, each of said summing means supplying through its output a signal corresponding to one of said diphase voltages.

13. A system as claimed in claim 2, wherein said second means for transforming said diphase voltages into three-phase voltages comprise means for adding said diphase voltages to said direct axis and quadrature axis currents flowing respectively through a negative resistance, called the armature negative resistance, this negative resistance cancelling the unwanted resistances present in the simulation system, a multiplier unit receiving the output signals from each of said adding means and for multiplying same by each of said sinusoidal and cosinusoidal functions of the oscillator unit, and second adding means connected to said multiplier unit for generating said three-phase voltages.

14. A system as claimed in claim 13, wherein a voltage step-up transformer is fed, through its primary windings, each of said three-phase voltages via a power amplifier connected to an insulating transformer the secondary of which is connected to an inductance called the armature physical inductance.

15. A system as claimed in claim 3, wherein said means for generating the dynamic characteristics of the machine comprise means for multiplying the total saturated flux by said direct axis and quadrature axis currents, and a differential adder connected to said multiplying means and supplying a signal corresponding to a torque appearing on the shaft of said machine.

16. A system as claimed in claim 15, wherein said means for generating the dynamic characteristics of the machine further comprise third transformer means for transforming said three-phase voltages into diphase voltages by means of adder elements and a multiplier unit for selectively multiplying the latter phase voltages with said diphase currents, the output signals from the multipliers of the units being added two by two by separate differential adders so as to define the instantaneous power and the reactive power of said machine.

17. A system as claimed in claim 7, wherein said mutual saturated flux are determined in function of an exciting signal provided by an exciter unit which comprises means for generating a control voltage in function of said three-phase voltages developed by said second transforming means, and means for limiting to a maximum value said exciting signal in function of said control voltage and of an auxiliary voltage, the latter voltage being either variable or fixed and defining the upper value of said exciting voltage.

18. A system as claimed in claim 17, wherein said control signal feeds a gain correcting element connected to said means defining said maximum value.

19. A system as claimed in claim 17, wherein said control signal is stabilized by a stabilizing signal which is a function of a signal corresponding to the instantaneous power of said machine and of a signal corresponding to a gating opening when said machine is used as a generator.

20. A system as claimed in claim 19, wherein said stabilizing signal is delivered by a stabilizer unit which comprises the series combination of a substractor fed by the signals corresponding to the instantaneous power and to the gating opening, two parallely connected low-pass filters supplying a comparator connected to a voltage limiter through a phase and amplitude correcting circuit.

* * * * *